US011274399B2

(12) United States Patent
Svending et al.

(10) Patent No.: US 11,274,399 B2
(45) **Date of Patent: *Mar. 15, 2022**

(54) PAPER AND PAPERBOARD PRODUCTS

(71) Applicant: FIBERLEAN TECHNOLOGIES LIMITED, Cornwall (GB)

(72) Inventors: Per Svending, Kungalv (SE); Jonathan Stuart Phipps, Cornwall (GB); Johannes Kritzinger, Olten (SE); Tom Larson, Cornwall (GB); Tania Selina, Cornwall (GB); David Skuse, Cornwall (GB)

(73) Assignee: FiberLean Technologies Limited, Cornwall (GB)

( * ) Notice: Subject to any disclaimer, the term of this patent is extended or adjusted under 35 U.S.C. 154(b) by 0 days.

This patent is subject to a terminal disclaimer.

(21) Appl. No.: 17/004,333

(22) Filed: Aug. 27, 2020

(65) Prior Publication Data

US 2020/0392670 A1 Dec. 17, 2020

Related U.S. Application Data

(60) Continuation of application No. 16/233,458, filed on Dec. 27, 2018, now Pat. No. 10,801,162, which is a division of application No. 15/475,487, filed on Mar. 31, 2017, now Pat. No. 10,214,859.

(30) Foreign Application Priority Data

Apr. 5, 2016 (GB) ..... 1605797

(51) Int. Cl.

| | |
|---|---|
| ***D21H 19/52*** | (2006.01) |
| ***D21H 11/04*** | (2006.01) |
| ***D21H 11/14*** | (2006.01) |
| ***D21H 11/18*** | (2006.01) |
| ***D21H 17/28*** | (2006.01) |
| ***D21H 17/67*** | (2006.01) |
| ***D21H 17/68*** | (2006.01) |
| ***D21H 21/10*** | (2006.01) |
| ***D21H 27/32*** | (2006.01) |

(52) U.S. Cl.

CPC ..... *D21H 27/32* (2013.01); *D21H 11/04* (2013.01); *D21H 11/14* (2013.01); *D21H 11/18* (2013.01); *D21H 17/28* (2013.01); *D21H 17/67* (2013.01); *D21H 17/675* (2013.01); *D21H 17/68* (2013.01); *D21H 19/52* (2013.01); *D21H 21/10* (2013.01)

(58) Field of Classification Search

CPC ..... D21H 11/18; D21H 11/04; D21H 19/38; D21H 17/67; D21H 17/675; D21H 19/52; D21H 17/68; D21H 27/32; D21H 11/14; D21H 17/28; D21H 17/63; D21H 21/10; D21H 23/48; D21H 27/30; D21H 27/38; D21H 17/25; D21H 27/10; B32B 29/06

See application file for complete search history.

(56) References Cited

U.S. PATENT DOCUMENTS

| | | | |
|---|---|---|---|
| 2,006,209 | A | 6/1935 | Bradner |
| 3,075,710 | A | 1/1963 | Feld et al. |
| 3,560,334 | A | 2/1971 | Arledter |
| 3,765,921 | A | 10/1973 | Puskar |
| 3,794,558 | A | 2/1974 | Back |
| 3,820,548 | A | 6/1974 | Buchmann et al. |
| 3,921,581 | A | 11/1975 | Brewer |
| 4,026,762 | A | 5/1977 | Bauman |
| 4,087,317 | A | 5/1978 | Roberts |
| 4,167,548 | A | 9/1979 | Arduini et al. |
| 4,229,250 | A | 10/1980 | Lehtinen |
| 4,275,084 | A | 6/1981 | Ohyabu et al. |
| 4,285,842 | A | 8/1981 | Herr |

(Continued)

FOREIGN PATENT DOCUMENTS

| | | |
|---|---|---|
| AU | 2010247184 B2 | 1/2013 |
| BE | 1006908 A3 | 1/1995 |

(Continued)

OTHER PUBLICATIONS

Abe et al., "Obtaining Cellulose Nanofibers with a Uniform Width of 15nm from Wood," Biomacromolecules (2007) 8: 3276-3278.

Chinga-Carrasco and Syverud, "Computer-Assisted Quantification of the Muli-Scale Structure of Films Made of Nanofibrillated Cellulose," J Nanopart Res (2010) 12:841-851.

Crofton et al., "Dielectric Studies of Cellulose and Its Derivatives: 1. Acetylation of Cellulose," Polymer (1982) 23:1605-1608.

Esau, Katherine, "Chapter 4, Cell Wall," Anatomy of Seed Plants, 2nd Edition, (1977) pp. 43-48.

Fahn, A., "Plant Anatomy Fourth Edition," (1990) pp. 32-39.

(Continued)

*Primary Examiner* — Jose A Fortuna

(74) *Attorney, Agent, or Firm* — Raymond G. Arner; Pierce Atwood LLP

(57) ABSTRACT

The present invention is directed to products, such as paper and paperboard products, comprising a substrate containing cellulose and top ply comprising microfibrillated cellulose and inorganic particulate, to methods of making such paper and paperboard products, and associated uses of such paper and paperboard products. The microfibrillated cellulose and inorganic particulate material are applied at the stage when the wet substrate is in the process of being formed on the wire of a papermaking machine, thereby avoiding the additional cost of more extensive equipment and machinery as well as in separate drying of a coating. The microfibrillated cellulose facilitates the application of inorganic particulate onto the surface of a wet paper or paperboard substrate when applied thusly, by trapping the inorganic particulate on the surface of the substrate and by giving the composite sufficient strength and a suitable pore structure to make it suitable for printing and other end-use demands.

23 Claims, 7 Drawing Sheets

(56) References Cited

U.S. PATENT DOCUMENTS 4,318,959 A 3/1982 Evans et al.
4,341,807 A 7/1982 Turbak et al.
4,356,060 A 10/1982 Neckermann et al.
4,374,702 A 2/1983 Turbak et al.
4,378,381 A 3/1983 Turbak et al.
4,452,721 A 6/1984 Turbak et al.
4,452,722 A 6/1984 Turbak et al.
4,460,737 A 7/1984 Evans et al.
4,464,287 A 8/1984 Turbak et al.
4,474,949 A 10/1984 Chatterjee et al.
4,481,076 A 11/1984 Herrick
4,481,077 A 11/1984 Herrick
4,487,634 A 12/1984 Turbak et al.
4,500,546 A 2/1985 Turbak et al.
4,510,020 A 4/1985 Green et al.
4,705,712 A 11/1987 Cashaw et al.
4,744,987 A 5/1988 Mehra et al.
4,761,203 A 8/1988 Vinson
4,820,813 A 4/1989 Schulz
4,889,594 A 12/1989 Gavelin
4,952,278 A 8/1990 Gregory et al.
5,009,886 A 4/1991 Ahmad et al.
5,061,346 A 10/1991 Taggart et al.
5,098,520 A 3/1992 Begala
5,104,411 A 4/1992 Makoui et al.
5,123,962 A 6/1992 Komuro et al.
5,152,872 A 10/1992 Racine et al.
5,223,090 A 6/1993 Klungness et al.
5,225,041 A 7/1993 Richard et al.
5,227,024 A 7/1993 Gomez
5,228,900 A 7/1993 Stephens et al.
5,240,561 A 8/1993 Kaliski
5,244,542 A 9/1993 Bown et al.
5,269,470 A 12/1993 Ishikawa et al.
5,274,199 A 12/1993 Uryu et al.
5,279,663 A 1/1994 Kaliski
5,312,484 A 5/1994 Kaliski
5,316,621 A 5/1994 Kitao et al.
5,385,640 A 1/1995 Weibel et al.
5,443,902 A 8/1995 Knox et al.
5,576,617 A 11/1996 Webb et al.
5,731,080 A 3/1998 Cousin et al.
5,817,381 A 10/1998 Chen et al.
5,837,376 A 11/1998 Knox et al.
5,840,320 A 11/1998 Odom
5,964,983 A 10/1999 Dinand et al.
6,037,380 A 3/2000 Venables et al.
6,074,524 A 6/2000 Wu et al.
6,083,582 A 7/2000 Chen et al.
6,102,946 A 8/2000 Nigam
6,117,305 A 9/2000 Bando et al.
6,117,474 A 9/2000 Kamada et al.
6,117,545 A 9/2000 Cavaille et al.
6,117,804 A 9/2000 Cho
6,132,558 A 10/2000 Dyllick-Brenzinger et al.
6,156,118 A 12/2000 Silenius
6,159,335 A 12/2000 Owens et al.
6,183,596 B1 2/2001 Matsuda et al.
6,202,946 B1 3/2001 Virtanen
6,214,163 B1 4/2001 Matsuda et al.
6,235,150 B1 5/2001 Middleton et al.
6,312,669 B1 11/2001 Cantiani et al.
6,339,898 B1 1/2002 Toye
6,379,594 B1 4/2002 Döpfner et al.
6,436,232 B1 8/2002 Silenius et al.
6,579,410 B1 6/2003 Bleakley et al.
6,604,698 B2 8/2003 Verhoff et al.
6,647,662 B2 11/2003 Toye
6,669,882 B2 12/2003 Seok
6,726,807 B1 4/2004 Mathur
6,787,497 B2 9/2004 Dellve et al.
6,861,081 B2 3/2005 Weibel
7,022,756 B2 4/2006 Singer
7,048,900 B2 5/2006 Mathur et al.
7,083,703 B2 8/2006 Aho et al.
7,169,258 B2 1/2007 Rheims et al.
7,179,347 B2 2/2007 Rheims et al.
7,285,182 B2 10/2007 Mason et al.
7,381,294 B2 6/2008 Suzuki et al.
7,459,493 B2 12/2008 Singer
7,462,232 B2 12/2008 Tuason et al.
7,594,619 B2 9/2009 Ghere, Jr. et al.
7,726,592 B2 6/2010 Fernandez et al.
7,790,276 B2 9/2010 Kanakarajan
7,799,358 B2 9/2010 Weibel
8,012,312 B2 9/2011 Goto et al.
8,101,250 B2 1/2012 Haenen et al.
8,231,764 B2 7/2012 Husband et al.
8,728,273 B2 5/2014 Heiskanen et al.
9,127,405 B2 9/2015 Husband et al.
9,175,441 B2 11/2015 Heiskanen et al.
9,267,050 B2 2/2016 Heiskanen et al.
10,801,162 B2 * 10/2020 Svending ..... D21H 11/14
2001/0011516 A1 8/2001 Cantiani et al.
2002/0031592 A1 3/2002 Weibel
2002/0059886 A1 5/2002 Merkley et al.
2002/0081362 A1 6/2002 Weibel
2002/0198293 A1 12/2002 Craun et al.
2003/0051841 A1 3/2003 Mathur et al.
2003/0094252 A1 5/2003 Sundar et al.
2003/0114641 A1 6/2003 Kelly et al.
2004/0108081 A1 6/2004 Hughes
2004/0146605 A1 7/2004 Weibel
2004/0149403 A1 8/2004 Rheims et al.
2004/0168782 A1 9/2004 Silenius et al.
2004/0168783 A1 9/2004 Munchow
2004/0173329 A1 9/2004 Silenius et al.
2004/0226671 A1 11/2004 Nguyen et al.
2005/0000665 A1 1/2005 Doelle
2005/0045288 A1 3/2005 Riou
2005/0051054 A1 3/2005 White et al.
2005/0089601 A1 4/2005 Weibel
2005/0103459 A1 5/2005 Mathur
2005/0133643 A1 6/2005 Fernandez et al.
2005/0194477 A1 9/2005 Suzuki
2005/0256262 A1 11/2005 Hill et al.
2006/0078647 A1 4/2006 Weibel
2006/0201646 A1 9/2006 Gussinyer Canadell
2006/0266485 A1 11/2006 Knox et al.
2006/0280839 A1 12/2006 Weibel
2006/0289132 A1 12/2006 Heijnesson-Hulten
2007/0062009 A1 3/2007 Ghere et al.
2007/0131361 A1 6/2007 Doelle et al.
2007/0148365 A1 6/2007 Knox et al.
2007/0224419 A1 9/2007 Sumnicht et al.
2007/0226919 A1 10/2007 Mheidle
2007/0231568 A1 10/2007 Kanakarajan
2007/0272376 A1 11/2007 Maijala et al.
2008/0023161 A1 1/2008 Gather
2008/0057307 A1 3/2008 Koslow et al.
2008/0060774 A1 3/2008 Zuraw et al.
2008/0146701 A1 6/2008 Sain et al.
2008/0210391 A1 9/2008 Pfalzer et al.
2008/0265222 A1 10/2008 Ozersky et al.
2009/0020139 A1 1/2009 Sumnicht et al.
2009/0020248 A1 1/2009 Sumnicht et al.
2009/0065164 A1 3/2009 Goto et al.
2009/0084874 A1 4/2009 Alam et al.
2009/0221812 A1 9/2009 Ankerfors et al.
2010/0024998 A1 2/2010 Wildlock et al.
2010/0059191 A1 3/2010 Garcia Melgarejo et al.
2010/0132901 A1 6/2010 Wild
2010/0139527 A1 6/2010 Fernandez-Garcia
2010/0212850 A1 8/2010 Sumnicht et al.
2010/0233468 A1 9/2010 Ioelovich et al.
2010/0272980 A1 10/2010 Kowata et al.
2011/0025953 A1 2/2011 Akao et al.
2011/0081554 A1 4/2011 Ankerfors et al.
2011/0088860 A1 4/2011 Heijnesson-Hulten et al.
2011/0114765 A1 5/2011 Brady et al.
2011/0186252 A1 8/2011 Subramanian et al.
2011/0223401 A1 9/2011 Harlin et al.
2011/0259537 A1 10/2011 Husband et al.
2012/0012031 A1 1/2012 Husband et al.

(56) References Cited

U.S. PATENT DOCUMENTS

| | | | | |
|---|---|---|---|---|
| 2012/0043039 | A1 | 2/2012 | Paltakari et al. | |
| 2012/0205065 | A1 | 8/2012 | Esser | |
| 2012/0216718 | A1 | 8/2012 | Berglund et al. | |
| 2012/0251818 | A1 | 10/2012 | Axrup et al. | |
| 2013/0000855 | A1 | 1/2013 | Nuopponen et al. | |
| 2013/0017349 | A1 | 1/2013 | Heiskanen et al. | |
| 2013/0017394 | A1 | 1/2013 | Hua et al. | |
| 2013/0047893 | A1 | 2/2013 | Heiskanen et al. | |
| 2013/0053454 | A1 | 2/2013 | Heiskanen et al. | |
| 2013/0126112 | A1 | 5/2013 | Gane et al. | |
| 2013/0131193 | A1 | 5/2013 | Gane et al. | |
| 2013/0180680 | A1 | 7/2013 | Axrup et al. | |
| 2013/0199745 | A1 | 8/2013 | Virtanen et al. | |
| 2013/0202870 | A1 | 8/2013 | Malmborg et al. | |
| 2013/0209772 | A1 | 8/2013 | Sandström et al. | |
| 2013/0280545 | A1 | 10/2013 | Husband et al. | |
| 2013/0292279 | A1 | 11/2013 | Bengtsson et al. | |
| 2014/0004340 | A1 | 1/2014 | Saastamoinen et al. | |
| 2014/0050922 | A1 | 2/2014 | Chin et al. | |
| 2014/0073774 | A1 | 3/2014 | Heiskanen et al. | |
| 2014/0154756 | A1 | 6/2014 | Nelson et al. | |
| 2014/0251856 | A1 | 9/2014 | Larsson et al. | |
| 2014/0272163 | A1 | 9/2014 | Tilton | |
| 2014/0302336 | A1 | 10/2014 | Heiskanen et al. | |
| 2015/0096700 | A1 | 4/2015 | Heiskanen et al. | |
| 2015/0114581 | A1 | 4/2015 | Kinnunen et al. | |
| 2015/0140237 | A1 | 5/2015 | Schmidt et al. | |
| 2015/0184345 | A1 | 7/2015 | Nelson et al. | |
| 2015/0191036 | A1 | 7/2015 | Ratnakumar et al. | |
| 2015/0225590 | A1 | 8/2015 | Iotti et al. | |
| 2015/0299959 | A1 | 10/2015 | Axrup et al. | |
| 2015/0315748 | A1 | 11/2015 | Imppola et al. | |
| 2015/0330025 | A1 | 11/2015 | Luna Marroquín et al. | |
| 2015/0354139 | A1 | 12/2015 | Geisen et al. | |
| 2016/0016717 | A1 | 1/2016 | Toubeau et al. | |
| 2016/0024718 | A1 | 1/2016 | Lee et al. | |
| 2016/0053437 | A1 | 2/2016 | Husband et al. | |
| 2016/0060814 | A1 | 3/2016 | Hauschel et al. | |
| 2016/0168696 | A1 | 6/2016 | Missoum et al. | |
| 2016/0176989 | A1 | 6/2016 | Laukkanen et al. | |
| 2016/0230341 | A1 | 8/2016 | Husband et al. | |
| 2017/0057118 | A1 | 3/2017 | Ozyhar et al. | |
| 2017/0190799 | A1 | 7/2017 | Rissanen et al. | |
| 2017/0204567 | A1 | 7/2017 | Yu et al. | |
| 2017/0284030 | A1* | 10/2017 | Svending | D21H 11/14 |
| 2017/0306562 | A1 | 10/2017 | Phipps et al. | |
| 2019/0127920 | A1* | 5/2019 | Svending | D21H 11/14 |
| 2020/0392670 | A1* | 12/2020 | Svending | D21H 17/67 |
| 2021/0277607 | A1* | 9/2021 | Svending | D21H 17/28 |

FOREIGN PATENT DOCUMENTS

| | | | |
|---|---|---|---|
| CA | 1096676 | A | 3/1981 |
| CA | 1149219 | A | 7/1983 |
| CA | 1162819 | A | 2/1984 |
| CA | 2292587 | A1 | 12/1998 |
| CA | 2093545 | C | 3/2001 |
| CA | 2437616 | A1 | 2/2005 |
| CA | 2750082 | A1 | 8/2010 |
| CA | 2748137 | A1 | 11/2010 |
| CA | 2832775 | A1 | 5/2015 |
| CH | 648071 | A5 | 2/1985 |
| CN | 1173904 | A | 2/1998 |
| CN | 1278830 | A | 1/2001 |
| CN | 1086189 | C | 6/2002 |
| CN | 1585839 | A | 2/2005 |
| CN | 1325725 | C | 7/2007 |
| DK | 175143 | B1 | 6/2004 |
| EP | 0041056 | A1 | 2/1981 |
| EP | 0039628 | A1 | 11/1981 |
| EP | 0051230 | A1 | 5/1982 |
| EP | 0198622 | A1 | 10/1986 |
| EP | 0273745 | B1 | 2/1991 |
| EP | 0442183 | A1 | 8/1991 |
| EP | 0492600 | A1 | 7/1992 |
| EP | 0499578 | A1 | 8/1992 |
| EP | 0579171 | A1 | 1/1994 |
| EP | 0614948 | A1 | 9/1994 |
| EP | 0619140 | A2 | 10/1994 |
| EP | 0785307 | A2 | 7/1997 |
| EP | 0790135 | A2 | 8/1997 |
| EP | 0988322 | B1 | 1/2002 |
| EP | 1053213 | B1 | 5/2002 |
| EP | 1469126 | A1 | 10/2004 |
| EP | 1538257 | A1 | 6/2005 |
| EP | 1936032 | A1 | 6/2008 |
| EP | 2196579 | A1 | 6/2010 |
| EP | 2216345 | A1 | 8/2010 |
| EP | 2236545 | A1 | 10/2010 |
| EP | 2236664 | A1 | 10/2010 |
| EP | 1907626 | B1 | 11/2010 |
| EP | 2607397 | A1 | 6/2013 |
| EP | 2730698 | A1 | 5/2014 |
| EP | 2861800 | B1 | 2/2017 |
| EP | 2640893 | B1 | 8/2017 |
| ES | 2100781 | A1 | 6/1997 |
| FR | 2689530 | A1 | 10/1993 |
| FR | 2730251 | A1 | 2/1995 |
| FR | 2774702 | A1 | 8/1999 |
| FR | 2992982 | A1 | 1/2014 |
| GB | 663621 | A | 12/1951 |
| GB | 2260146 | A | 4/1993 |
| GB | 2265916 | A | 10/1993 |
| GB | 2275876 | A | 9/1994 |
| JP | S59132926 | A | 7/1984 |
| JP | 1156587 | A | 6/1989 |
| JP | H 05-098589 | A | 4/1993 |
| JP | 6158585 | A | 6/1994 |
| JP | H0-61558585 | A | 6/1994 |
| JP | H08-81896 | A | 3/1996 |
| JP | 2528487 | B2 | 8/1996 |
| JP | 8-284090 | A | 10/1996 |
| JP | H0-8284090 | A | 10/1996 |
| JP | 9-124702 | A | 5/1997 |
| JP | H09124702 | A | 5/1997 |
| JP | 09209295 | A | 8/1997 |
| JP | 10158303 | A | 6/1998 |
| JP | 2-976485 | B2 | 11/1999 |
| JP | 2004-231796 | A | 8/2004 |
| JP | 2004-523676 | A | 8/2004 |
| JP | 2006-008857 | A | 1/2006 |
| JP | 2007-262594 | A | 10/2007 |
| JP | 2008-169497 | A | 7/2008 |
| JP | 2009-161613 | A | 7/2009 |
| JP | 2009-243014 | A | 10/2009 |
| JP | 2009-263854 | A | 11/2009 |
| JP | 2010-503775 | A | 2/2010 |
| JP | 2010-513741 | A | 4/2010 |
| JP | 2010-168716 | A | 8/2010 |
| JP | 2012-514137 | | 6/2012 |
| JP | 2012-522145 | A | 9/2012 |
| JP | 2013-527333 | A | 6/2013 |
| JP | 2014-503696 | A | 2/2014 |
| JP | 5419120 | B2 | 2/2014 |
| JP | 5572169 | B2 | 7/2014 |
| JP | 2017166118 | A | 9/2017 |
| KR | 10-2009-0109532 | A | 10/2009 |
| NL | 8102857 | A | 1/1983 |
| SU | 499366 | A1 | 1/1977 |
| TW | 201013017 | A1 | 4/2010 |
| WO | 8503316 | A1 | 8/1985 |
| WO | 8808899 | A1 | 11/1988 |
| WO | 93/01333 | A1 | 1/1993 |
| WO | 93/15270 | A1 | 8/1993 |
| WO | 94/04745 | A1 | 3/1994 |
| WO | 97/18897 | A2 | 5/1997 |
| WO | 98/55693 | A1 | 12/1998 |
| WO | 98/56826 | A1 | 12/1998 |
| WO | 99/54045 | A1 | 10/1999 |
| WO | 00/66510 | A1 | 11/2000 |
| WO | 01/66600 | A1 | 9/2001 |
| WO | 01/98231 | A1 | 12/2001 |
| WO | 02/086238 | A1 | 10/2002 |
| WO | 02/100955 | A1 | 12/2002 |

(56) References Cited

FOREIGN PATENT DOCUMENTS

| | | | |
|---|---|---|---|
| WO | 03/033815 | A2 | 4/2003 |
| WO | 03/044250 | A1 | 5/2003 |
| WO | 2004/016852 | A2 | 2/2004 |
| WO | 2004055267 | A1 | 7/2004 |
| WO | 2005/014934 | A2 | 2/2005 |
| WO | 2005/100489 | A1 | 10/2005 |
| WO | 2005/123840 | A1 | 12/2005 |
| WO | 2006/009502 | A1 | 1/2006 |
| WO | 2006/041401 | A1 | 4/2006 |
| WO | 2007/006794 | A1 | 1/2007 |
| WO | 2007/091942 | A1 | 8/2007 |
| WO | 2007/096180 | A2 | 8/2007 |
| WO | 2007088974 | A1 | 8/2007 |
| WO | 2007/110639 | A1 | 10/2007 |
| WO | 2008/008576 | A2 | 1/2008 |
| WO | 2008/033283 | A1 | 3/2008 |
| WO | 2008/076056 | A1 | 6/2008 |
| WO | 2008/076071 | A1 | 6/2008 |
| WO | 2008/095764 | A1 | 8/2008 |
| WO | 2008/132228 | A1 | 11/2008 |
| WO | 2009/074491 | A1 | 6/2009 |
| WO | 2009/122982 | A1 | 10/2009 |
| WO | 2009/123560 | A1 | 10/2009 |
| WO | 2009/126106 | A1 | 10/2009 |
| WO | 2010/003860 | A2 | 1/2010 |
| WO | 2010/015726 | A1 | 2/2010 |
| WO | 2010/092239 | A1 | 8/2010 |
| WO | 2010/102802 | A1 | 9/2010 |
| WO | 2010/112519 | A1 | 10/2010 |
| WO | 2010/113805 | A1 | 10/2010 |
| WO | 2010/115785 | A1 | 10/2010 |
| WO | 2010/125247 | A2 | 11/2010 |
| WO | 2010/131016 | A2 | 11/2010 |
| WO | 2010131016 | A2 | 11/2010 |
| WO | 2011/004300 | A1 | 1/2011 |
| WO | 2011/004301 | A1 | 1/2011 |
| WO | 2011/042607 | A1 | 4/2011 |
| WO | 2011/048000 | A1 | 4/2011 |
| WO | 2011/056130 | A1 | 5/2011 |
| WO | 2011/059398 | A1 | 5/2011 |
| WO | 2011056135 | A1 | 5/2011 |
| WO | 2011/064441 | A1 | 6/2011 |
| WO | 2011/068457 | A1 | 6/2011 |
| WO | 2011078770 | A1 | 6/2011 |
| WO | 2011/134939 | A1 | 11/2011 |
| WO | 2011/141876 | A1 | 11/2011 |
| WO | 2011/141877 | A1 | 11/2011 |
| WO | 2011/154335 | A1 | 12/2011 |
| WO | 2012/039668 | A1 | 3/2012 |
| WO | 2012/066308 | A2 | 5/2012 |
| WO | 2012066308 | A2 | 5/2012 |
| WO | 2012/098296 | A2 | 7/2012 |
| WO | 2013/132017 | A1 | 9/2013 |
| WO | 2013/166285 | A1 | 11/2013 |
| WO | 2013166285 | A1 | 11/2013 |
| WO | 2013188739 | A1 | 12/2013 |
| WO | 2014033409 | A1 | 3/2014 |
| WO | 2014044870 | A1 | 3/2014 |
| WO | 2014/072912 | A1 | 5/2014 |
| WO | 2014/091212 | A1 | 6/2014 |
| WO | 2014091212 | A1 | 6/2014 |
| WO | 2014/102424 | A1 | 7/2014 |
| WO | 2014/111854 | A1 | 7/2014 |
| WO | 2014/181560 | A1 | 11/2014 |
| WO | 2014/202841 | A1 | 12/2014 |
| WO | 2015011337 | A1 | 1/2015 |
| WO | 2015032432 | A1 | 3/2015 |
| WO | 2015/136493 | A1 | 9/2015 |
| WO | 2015171714 | A1 | 11/2015 |
| WO | 2015180844 | A1 | 12/2015 |
| WO | 2015197906 | A1 | 12/2015 |
| WO | 2016/067180 | A1 | 5/2016 |
| WO | 2016097964 | A1 | 6/2016 |
| WO | 2016185332 | A1 | 11/2016 |
| WO | 2017/175062 | A1 | 10/2017 |
| WO | 2017/182877 | A1 | 10/2017 |
| WO | 2017175062 | A1 | 10/2017 |

OTHER PUBLICATIONS

Fengel et al., "Chapter 4. Cellulose," Wood Chemistry, Ultrastructure, Reactions, (1983) pp. 66-105.

Fengel, D., "Ideas on the Ultrastructure Organization of the Cell Wall Components," J. Polymer Sci.: Part C, No. 36 (1971) pp. 383-392.

Frey-Wyssling and Mühlethaler, "The Fine Structure of Cellulose." Fortschritte der Chemie Organischer Naturstoffe (1951) pp. 1-27.

Hult et al., "Cellulose Fibril Aggregation—An Inherent Property of Kraft Pulps," Polymer 42 (2001) pp. 3309-3314.

Ioelovich, Michael, "Cellulose as a Nanostructured Polymer: A Short Review," BioResources (2008) 3(4) pp. 1403-1418.

McGinnis and Shafizadeh, "Chapter 1 Cellulose and Hemicellulose," Pulp and Paper: Chemistry and Chemical Technology, (1980) pp. 1-38.

McGraw-Hill, "Cell Walls (Plant)," Encyclopedia of Science and Technology, 5th edition, (1982), pp. 737-741.

Pääkkö et al., "Enzymatic Hydrolysis Combined with Mechanical Shearing and High-Pressure Homogenization for Nanoscale Cellulose Fibrils and Strong Gels," Biomacromolecules (2007) 8:1934-1941.

Pöhler, Tiina & Lappalainen, Timo & Tammelin, Tekla & Eronen, Paula & Hiekkataipale, Panu & Vehniäinen, Annikki & M. Koskinen, Timo. (2011). "Influence of fibrillation method on the character of nanofibrillated cellulose (NFC)," 2010 TAPPI International Conference on Nanotechnology for the Forest Product Industry, Dipoli Congress Centre, Espoo, Finland, Sep. 27-29, 2010, 22 pages.

Rowland and Roberts, "The Nature of Accessible Surfaces in the Microstructure of Cotton Cellulose," Journal of Polymer Science: Part A-1, vol. 10, (1972) pp. 2447-2461.

Saito et al., "Homogenous Suspensions of Individualized Microfibrils from TEMPO-Catalyzed Oxidation of Native Cellulose," Biomacromolecules, (2006) vol. 7, No. 6, pp. 1687-1691.

Saito et al., "Cellulose Nanofibers Prepared by TEMPO-Mediated Oxidation of Native Cellulose," Biomacromolecules, (2007) 8:2485-2491.

Siró, Istvá, "Microfibrillated Cellulose and New Nanocomposite Materials: A Review," Cellulose (2010) 17:459-494.

"Paper Coating Pigments," TAPPI Monograph Series No. 30, 1966, pp. 34-35.

Hamann, Lutzm Papiertechnische Stiftung, SUNPAP Workshop May 10, 2011, Seventh Framework Programme, 24 pages.

Svending, Per, "Commercial Break-Through in MFC Processing," TAPPI International Conference on Nanotechnology tor Renewable Materials, Vancouver, British Columbia, Canada Jun. 23-26, 2014, 7 pages.

Search Report for United Kingdom Patent Application No. GB1605797.8, dated Feb. 28, 2017, 4 pages.

Xu, Xiaoman, "Study of the Relationship Between the Dispersion of Micro-Nano-Fibrillated Cellulose (MNFC) and their Ability in Curtain Coating," Dissertation Presented to University of Quebec in Trois-Rivieres, Aug. 2014, 128 pages.

Charfeddine et al., "3D Synchrotron X-Ray Microtomography for Paper Structure Characterization of Z-Structured Paper by Introducing Micro Nanofibrillated Cellulose," International Paper and Coating Chemistry Symposium /International Paper Physics Conference, Nordic Pulp & Paper Research Journal, vol. 31, No. 2, (2016) pp. 219-224.

Eriksen et al., "The Use of Microfibrillated Cellulose Produced from Kraft Pulp as Strength Enhancer in TMP Paper," Nordic Paper Pulp and Paper Research Journal, vol. 23, No. 3 (2008) pp. 299-304.

Syverud and Stenius, "Strength and Barrier Properties of MFC Films," Cellulose 16:75-85 (2009).

Dimic-Misic, "Micro and Nanofibrillated Cellulose (MNFC) as Additive in Complex Suspensions: Influence on Rheology and Dewatering," Doctoral Dissertations, Aalto University, Jun. 12, 2014, 152 pages.

(56) References Cited

OTHER PUBLICATIONS

Dimic-Misic et al., "Comparing the Rheological Properties of Novel Nanofibrillar Cellulose-Formulated Pigment Coating Dolours with Those Using Traditional Thickener," Nordic Pulp & Paper Research Journal, vol. 29, No. 2 (2014) pp. 253-270.
Roberts, J.C., "Chapter 2, The Material of Paper," The Chemistry of Paper, RSC Paperbacks, 1996, pp. 11-25.
Roberts, J.C., "Chapter 4, The Material of Paper," The Chemistry of Paper, RSC Paperbacks, 1996, pp. 52-68.
Roussiere, Fabrice; "Upgrading Thermo Mechanical Pulp with Micro-Nano Fibrillated Cellulose at Pilot Scale"; Paper Week Canada, Feb. 3, 2015; pp. 1-23.
University of Quebec; "Study of the Relationship Between the Dispersion of Micro-Nano-Fibrillated Cellulose (MNFC) and their Ability in Curtain Coating"; Aug. 2014; 127 Pages.
International Search Report and Written Opinion, PCT/IB2017/000450, dated Jul. 14, 2017 (11 pages).
Lavoine et al., "Impact of Different Coating Processes of Microfibrillated Cellulose on the Mechanical and Barrier Properties of Paper," J Materials Science, (2014) 49:2879-2893.
Lavoine et al., "Mechanical and Barrier Properties of Cardboard and 3D Packaging Coated with Microfibrillated Cellulose," J Applied Polymer Science, (2014) 11 pages.
Ankerfors et al., "The Use of Microfibrillated Cellulose in Fine Paper Manufacturing—Results from a Pilot Scale Papermaking Trial," Nordic Pulp & Paper Research Journal, (2014) 29(3):476-483.
Selder, H.; Mannes, W., and Matzke, W., "Broke systems for LWC, MWC and HWC Papers", Voith Sulzer Paper Technology, 8 pages, Dec. 2011.
Silenius, Petri, "Improving the Combinations of Critical Properties and Process Parameters of Printing and Writing Papers and Paperboards by New Paper-Filling Methods", Helsinki University of Technology Laboratory of Paper Technology Reports, Series A 14, Espoo 2002, 168 pages.
Sinnott et al., "Slurry Flow in a Tower Mill," Seventh International Conference on CFD in the Minerals and Process Industries, CSIRO, Melbourne, Australia, Dec. 9-11, 2009, pp. 1-7.
Somboon et al., "Grit Segments in TMP Refining. Part 1: Operating Parameters and Pulp Quality," Appita Journal, vol. 62, No. 1 (2009) pp. 37-41.
Somboon et al., "Grit Segments in TMP Refining. Part 2: Potential for Energy Reduction," Appita Journal, vol. 62, No. 1 (2009) pp. 42-45 and 59.
Somboon, Phichit, "On the Application of Grits to Thermomechanical Pulp Refining." TKK Reports on Forest Products Technology, Series A7, Espoo 2009, 61 pages.
Spence et al., "The Effect of Chemical Composition on Microfibrillar Cellulose Films from Wood Pulps: Mechanical Processing and Physical Properties," BioResource Technology, vol. 101 (2010) pp. 5961-5968.
Subramanian et al., "Calcium Carbonate—Cellulose Fibre Composites; The Role of Pulp Refining," Paper Technology (2006) pp. 27-31.
Subramanian, Ramjee, "Engineering Fine Paper by Utilising the Structural Elements of the Raw Materials", Doctoral Thesis, TKK Reports in Department of Forest ProductsTechnology, Series A1, Espoo 2008, 65 pages.
Yano, et al., "Production and use of Machine bio-nano-par φ," (2009) pp. 73-80.
Yano, Hiroyuki, "High Performance of Bio Fibers by the Addition of Filler," vol. 55, No. 4 (2009) pp. 63-68.
Waterhouse, J.F., "Whither Refining?" Institute of Paper Science and Technology, No. 649 (1997) 40 pages.
Australian Notice of Acceptance for Australian Patent Application No. 2019284017, dated Nov. 24, 2020, 3 pages.
Korean Notice of Office Action for Korean Patent Application No. 10-2020-7009842, dated Sep. 22, 2020, 7 pages.
Svending, Per, "Commercial Break-Through in MFC Processing," TAPPI International Conference on Nanotechnology for Renewable Materials, Vancouver, British Columbia, Canada Jun. 23-26, 2014, 17 pages.
Optifiner™ DF Deflakers, "Improved quality through effective deflaking " Stock Preparation and Recycled Fiber Systems, Metso Paper, (2006) 4 pages.
Peltola, Maarit, "Preparation of Microfibrillated Cellulose" Master of Science Thesis, Tampere University of Technology, May 2009, 98 pages.
Taniguchi, Takashi, "New Films Produced from Microfibrillated Natural Fibres," Polymer International, vol. 47 (1998) pp. 291-294.
Porubská, et al., "Homo- and Heteroflocculation of Papermaking Fines and Fillers," Colloids and Surfaces A: Physiochem. Eng. Aspects, Elsevier Science, vol. 210 (2002) pp. 223-230.
Terao et al., "Pulp-Filler Interaction (3)—The Influence of Wet Pressing and Cellulosic Fines Addition on the Structure and Properties of Filler Loaded Papers," vol. 8 (1989) pp. 65-73.
Thorn et al., "Applications of Wet-End Paper Chemistry, Chapter 6, Fillers," Springer Science+ Business Media B.V. (2009) pp. 113-136.
Syverud and Stenius, "Strength and Barrier Properties of MFC Films," Cellulose, (2009) 16:75-85.
Charfeddine, Ma; "Impact on Paper Properties of Z-Direction Structuring by the Layered Addition of Micro-Nano-Fibrillated Cellulose (MNFC)"; 2014 Tappi Nanotechnology Conference, Vancouver, B.C.; Jun. 23-26, 2014. 2015; 32 Pages.
Charfeddine, Ma; "3D Structure Analysis of Z-Structured Paper by the Layered Addition of Micro-Nano-Fibrillated CellulosE (MNFC)"; Arboranano; Mac 2015; IPPC; 20 Pages.
International Preliminary Report on Patentability for International Patent Application No. PCT/IB2017/000450, dated Jul. 20, 2018 and PCT Rule 66 Response Filed Apr. 5, 2018, 15 pages.
Ahola, Susanna, "Properties and Interfacial Behaviour of Cellulose Nanofibrils." Doctoral Thesis, 2008, 82 pages.
Ankerfors, et al. "NanoCellulose Developments in Scandinavia", Paper and Coating Chemistry Symposium (PCCS), Jun. 2009, Hamilton, Canada, 43 pages.
Ankerfors, Mikael, "The manufacture of microfibrillated cellolose (MFC) its applications", Nanostructured cellulose and new cellulose derivatives seminar, Nov. 2006, pp. 1-40.
Berglund, et al. "Nanostructured Cellulose Products", Finnish-Swedish Wood Material Science Research Programme Opening Seminar, 2004, Helsinki, Finland, 28 pages.
Bhatnagar, et al. "Processing of Cellulose Nanofiber-reinforced Composites", Journal of Reinforced Plastics and Composites, vol. 24, No. 12, 2005, pp. 1259-1268.
Characterisation Newsletter, "Microfibrillated Cellulose", No. 5, Jan. 2009, pp. 1-2.
Kumar et al., "Comparison of Nano- and Microfibrillated Cellulose Films," Cellulose (2014) vol. 21 p. 3443-3456.
Grant and PPI's National Editors, "Coated-Paper Producers Look Forward to Brighter Times," Pulp and Paper International (1994) 18-31.
Eichhorn, et al., "Review: Current International Research into Cellulose Nanofibres and Nanocomposites," Journal of Materials Science, vol. 45, No. 1, (2010) pp. 1-33.
Smook, Handbook for Pulp and Paper Technologies, 1992, Angus Wilde Publications, 2nd Edition, Chap. 13.
Mullite, 2001 [downloaded on-line Dec. 6, 2016], Mineral Data Publishing, 1 page.
Pinkney et al., "Microfibrillated Cellulose—A New Structural Material," Engineering Doctorate Conference (2012), University of Birmingham, 2 pages.
Zou, Xuejun, "Production of Nanocrystalline Cellulose and its Potential Applications in Specialty Papers", Pira Specialty Papers Conference, Nov. 2010, pp. 1-30.
Fukui, Yoshitaka, "Microfibrillated Cellulose", vol. 60, No. 24, 1985, pp. 5-12.
Handbook of Pulp, Edited by Herbert Sixta, Wiley-VCH (2006), pp. 41-42—XP007918817.

(56) References Cited

OTHER PUBLICATIONS

Henriksson, Marielle, "Cellulose Nanofibril Networks and Composites, Preparation, Structure and Properties," KTH Chemical Science and Engineering, 2008, 60 pages.
Henriksson, et al., "Cellulose Nanopaper Structures of High Toughness," Biomacromolecules, vol. 9 (2008) pp. 1579-1585.
Hentze, Hans-Peter, "From Nanocellulose Science Towards Applications," VTT—Technical Research Center of Finland, PulPaper2010, Jun. 2010, Helsinki, pp. 1-24.
Subramanian, Ramjee, "Engineering Fine Paper by Utilizing the Structural Elements of the Raw Materials," TKK Reports in Department of Forest Products Technology, Series A1 Espoo 2008, Abstract 3 pages, retrieved from http://lib.tkk.fi/Diss/2008/isbn9789512295234/. http://puu.tkk.fi/em/research/research_groups/chemical_pupling_and_wood_refinery/seminar_presentations/43 knuts_100609_1aitoksen_sisainen_seminaariesitys.pdf;Knuts, M.SC. Aaro, "Process installation and optimization to D refine and produce NFC materials." pp. 1-9, 2010.
Hubbe et al. "What Happens to Cellulosic Fibers During Papermaking and Recycling? A Review", BioResources, vol. 2, No. 4, 2007, pp. 739-788.
Hubbe et al., "Cellulosic Nanocomposites: A Review," BioResources vol. 3, No. 3 (2008), pp. 929-980.
Zirconium, Silicate Data sheet, downloaded online from www.reade.com, downloaded on Jan. 12, 2012, 2 pages.
Husband et al., "The Influence of Kaolin Shape Factor on the Stiffness of Coated Papers," TAPPI Journal (2009) pp. 12-17.
Husband et al., "The Influence of Pigment Particle Shape on the In-Plane Tensile Strength Properties of Kaolin-Based Coating Layers," TAPPI Journal, vol. 5 No. 12 (2006) pp. 3-8.
Iwamoto, et al., "Nano-Fibrillation of Pulp Fibers for the Processing of Transparent Nanocomposites," Applied Physics A, vol. 89 (2007) pp. 461-466.
Iwamoto, et al., "Optically Transparent Composites Reinforced with Plant Fiber-Based Nanofibers," Applied Physics A, vol. 81 (2005) pp. 1109-1112.
Janardhnan and Sain, "Isolation of Cellulose Microfibrils—An Enzymatic Approach," BioResources, vol. 1, No. 2 (2006) pp. 176-188.
Kang, Taegeun, "Role of External Fibrillation in Pulp and Paper Properties," Doctoral Thesis, Helsinki University of Technology, Laboratory of Paper and Printing Technology Reports, Series A28, Espoo 2007, 50 pages.
Klemm, et al., "Nanocelluloses as Innovative Polymers in Research and Application," Adv. Polymer Science, vol. 205 (2006) pp. 49-96.
Klungness, et al. "Fiber-Loading: A Progress Report", TAPPI Proceedings, 1994 Recycling Symposium, pp. 283-290.
Zirconium Oxide Data sheet, downloaded online from www.stanfordmaterials.com, downloaded on Jan. 12, 2012, 7 pages.
Littunen, Kuisma, "Free Radical Graft Copolymerization of Microfibrillated Cellulose," Master's Thesis, Helsinki University of Technology, Sep. 2009, 83 pages.
Ioelovich and Figovsky, "Structure and Properties of Nanoparticles Used in Paper Compositions," Mechanics of Composite Materials, vol. 46, No. 4, 2010, pp. 435-442.
Zhao et al., "Ultrasonic Technique for Extracting Nanofibers from Nature Materials," Applied Physics Letters 90, 073112 (2007) 2 pages.
Ielovich, Michael, "Structure and Properties of Nano-Particles Used in Paper Compositions," XXI Tecnicelpa Conference and Exhibition/VI CIADICYP 2010, Portugal, 7 pages.
Luukkanen, Lauri, "Reducing of Paper Porosity and Roughness Through Layered Structure", Aalto University School of Science and Technology, Master's thesis for the degree of Master of Science in Technology, Espoo, May 2010, 132 pages.
Mathur, V. "GRI's Fibrous Filler Technology Presentation to TAPPI", Philadelphia, PA (slides only), (2005) pp. 1-10.
Yano, Hiroyuki, "Production and Use of Cellulose Nanofibers," Timber Financial Industrial Technology (2009) vol. 27, No. 1, pp. 14-22.
Product information for the Ultra-fine Friction Grinder "Supermasscolloider," 1 page, retrieved from http:www.masuko.com/English/product/Masscolloder.html (2014).
Mori, et al., "Effect of Cellulose Nano-Fiber on Calcium Carbonate Crystal Form," Polymer Preprints, Japan, vol. 56, No. 2 (2007) 1 page.
Mörseburg and Chinga-Carrasco, "Assessing the Combined Benefits of Clay and Nanofibrillated Cellulose in Layered TMP-Based Sheets," Cellulose, vol. 16, (2009) pp. 795-806.
Nakagaito and Yano, "The Effect of Fiber Content on the Mechanical and Thermal Expansion Properties of Biocomposites Based on Microfibrillated Cellulose," Cellulose, vol. 15 (2008) pp. 555-559.
ATREX G-Series, Megatrex, "Technology for Reject Treatment and Recovery", 2 pages.
Nakagaito, Antonio Norio, Preparation of Bio Fiber and their Application, pp. 73-80.
Innventia, "Processes for Nano cellulose," http://www.innventia.com/templates/STFIPage_ 9108.aspx, 2011, 1 page.
Ioelovich, Michael, "Structure and Properties of Nano-Particles Used in Paper Compositions," XXI TECNICELPA Conference and Exhibition/VI CIADICYP 2010, Portugal, 7 pages.
Extended European Search Report for European Patent Application No. 20217993.3, dated Feb. 5, 2021, 7 pages.
Russian Office Action for Russian Application No. 2020123287/03, dated Feb. 11, 2021, 7 pages.
Japanese Notice of Reasons For Rejection for Japanese Application No. 2019-218065, dated Apr. 20, 2021, 9 pages.
Japanese Notice of Reasons For Rejection for Japanese Application No. 2019-218066, dated Apr. 20, 2021, 9 page.
Australian Examination Report dated Jan. 8, 2019, for corresponding Australian Patent Application No. 2017247687, 2 pages.
Canadian Office Action dated May 15, 2019, for corresponding Canadian Patent Application No. 3,019,443, 4 pages.
Chinese Office Action dated Apr. 11, 2019, for corresponding Chinese Patent Application No. 2017800021868.1, 3 pages.
European Office Action dated Aug. 5, 2019, for corresponding European Patent Application No. 17724436.5, 3 pages.
Japanese Office Action dated Aug. 6, 2019, for corresponding Japanese Patent Application No. 2018-550549, 3 pages.
Korean Office Action dated May 31, 2019, for corresponding Korean Patent Application No. 10-2018-7031526, 5 pages.
Korean Office Action dated Oct. 3, 2019, for corresponding Korean Patent Application No. 10-2018-7031526, 7 pages.
Written Opinion of the International Preliminary Examining Authority (PCT Rule 66) for International Patent Application No. PCT/IB2017/000450, dated Mar. 8, 2018, 5 pages.
Mill (grinding) http://en_wikipedia.org/w/index.php?title-File:Hammer_mill_open-_front_full.jgp, (2010) 8 pgs.
Syverud, et al. "The influence of Microfibrillated Cellulose, MFC, on Paper Strength and Surface Properties", Paper and Fibre Research Institute (PFI AS), Trondheim, Norway and Norwegian University of Science and Technology (NTNU), Trondheim, Norway. Dec. 8, 2011, pp. 1-32.
Brazil Office Action for Brazilian Application No. BR112018069538-6, dated May 25, 2021, 4 pages.
Korea Office Action for Korean Application No. 10-2021-7018848, dated Sep. 6, 2021, 5 pages.

* cited by examiner

PAPER AND PAPERBOARD PRODUCTS

CROSS REFERENCE TO RELATED APPLICATIONS

This application is a continuation of U.S. application Ser. No. 16/233,458, filed Dec. 27, 2018, which is a divisional of U.S. application Ser. No. 15/475,487, filed Mar. 31, 2017 (now U.S. Pat. No. 10,214,859) and claims the benefit of United Kingdom Patent Application No. 1605797.8, filed Apr. 5, 2016, the entire contents of which is incorporated herein by reference.

TECHNICAL FIELD

The present invention is directed to paper or paperboard products, comprising a substrate and at least one top ply comprising a composite of microfibrillated cellulose and at least one inorganic particulate material in an amount that is suitable for imparting improved optical, surface and/or mechanical properties to such paper or paperboard products to render them suitable for printing and other end-use demands, to methods of making paper or paperboard products by a process of applying a composite of microfibrillated cellulose and at least one inorganic particulate material on to the wet substrate on the wire at the wet end of a papermaking machine, and to associated uses of such paper or paperboard products.

BACKGROUND OF THE INVENTION

Paper and paperboard products are many and various. There is an ongoing need to make quality improvements in paper and paperboard products having optical, surface and/or mechanical properties, which render them suitable for printing and other end-use demands, and to improve the methods for making such paper and paperboard products having improved printability and surface properties, e.g., by reducing cost, making the process more energy efficient and environmentally friendly, and/or improving recyclability of the paper product.

White top linerboard is conventionally made on a multiformer paper machine. The top layer of a white top linerboard frequently comprises a lightly refined bleached hardwood Kraft (short) fibre, which may contain filler in an amount up to about 20 wt. %. The top layer is conventionally applied to cover the base with a layer to improve the optical appearance of the linerboard and to achieve a surface of high brightness suitable for printing or as a base for coating. A pulp-based layer is conventionally used because the base layer normally comprises either unbleached Kraft pulp or recycled paperboard ("OCC," old corrugated containers), and is thus very rough and unsuitable for coating with conventional equipment. White top linerboards are most often printed flexographically, although some offset printing is used, and inkjet techniques are growing in significance.

With the decline in traditional printing and writing grades, many mills have been looking to convert their graphic paper machines to make linerboard or other packaging products. Conversion of a single layer machine to a multiformer requires a major rebuild and investment, and without this the machine would be limited to making simple linerboard grades. Application of a suitable coating composite to produce a white top linerboard product through a suitable coating apparatus operating at the wet end of the paper machine would provide simple and low cost possibility for the machine to produce economically white top linerboard products. Applying low solids content slurry of microfibrillated cellulose and organic particulate material to the surface of a linerboard substrate at this point in the linerboard production process would allow the white top linerboard to be drained using existing drainage elements and the resulting white top linerboard to be pressed and dried as a conventional sheet.

Coating onto a wet, freshly-formed substrate presents challenges. Among these challenges, is the fact that the surface of a wet substrate will be much rougher than a pressed and dried sheet. For this reason, the top ply slurry of the composite of microfibrillated cellulose and organic particulate material must create a uniform flow or curtain of the composite material at a suitable flowrate. Moreover, the top ply slurry must be introduced onto the wet web evenly to obtain a contour coat. Once pressed and dried, the top ply must present a surface which is suitable either for printing directly or for single coating. Low porosity and good surface strength are therefore very important properties for the finished white top linerboard.

SUMMARY OF THE INVENTION

According to a first aspect of the present invention, there is provided a paper or paperboard product comprising:

(i) a cellulose-containing substrate; and (ii) a top ply comprising an inorganic particulate material and at least about 5 wt. % microfibrillated cellulose, based on the total weight of the top ply;

wherein the weight ratio of inorganic particulate material to microfibrillated cellulose in the top ply is from about 20:1 to about 3:1 and further wherein the top ply has a brightness of at least about 65% according to ISO Standard 11475.

In certain embodiments the paperboard products are a white top paperboard or a white top linerboard.

According to a second aspect of the present invention, there is provided a paper or paperboard product comprising:

(i) a cellulose-containing substrate; and (ii) a top ply comprising inorganic particulate material in the range of about 67 wt. % to about 90 wt. % and at least about 10 wt. % microfibrillated cellulose, based on the total weight of the top ply, wherein the top ply is present in the paper or paperboard product in an amount ranging from about 15 g/m$^2$ to about 40 g/m$^2$.

In certain embodiments of the second aspect, the top ply is present in the product in an amount ranging from about 20 g/m$^2$ to about 30 g/m$^2$, particularly at least about 30 g/m$^2$.

In certain embodiments of the first and second aspect, the brightness measured (according to ISO Standard 11475 (F8; D65-400 nm)) on the top ply is increased compared to the brightness measured on the substrate on a surface opposite the top ply.

Advantageously, in certain embodiments the top ply provides good optical and physical coverage over a dark substrate, for example, a substrate of a brightness of 15-25, with the potential to yield an improved brightness of at least about 65%, at least about 70%, or at least about 80% at a coating weight of about 30 g/m$^2$.

In certain embodiments the product comprises or is a paperboard product, and in some embodiments the product is a white top paperboard, containerboard or linerboard product. In addition, improvements in brightness can be made utilizing the first and second aspects at coverages of about 30 g/m$^2$ to reach brightness levels of 80% or more compared to conventional white top coatings typically requiring 50-60 g/m$^2$ at lower filler loadings of typically 5-15 wt. %.

According to a third aspect, there is provided a paper or paperboard product comprising:

(i) a cellulose-containing substrate; and (ii) a top ply comprising inorganic particulate material in the range of about 67 wt. % to about 92 wt. % and microfibrillated cellulose in a range of 5 wt % to about 30 wt. % based on the total weight of the top ply.

In certain embodiments the weight ratio of inorganic particulate to microfibrillated cellulose in the top ply is from about, 8:1 to about 1:1, or from about 6:1 to about 3:1, or from about 5:1 to about 2:1, or from about 5:1 to about 3:1, or about 4:1 to about 3:1, According to a fourth aspect of the present invention, there is provided a method of making a paper or paperboard product, the method comprising: (a) providing a wet web of pulp; (b) providing a top ply slurry onto the wet web of pulp, wherein: (i) the top slurry is provided in an amount ranging from 15 g/m$^2$ to 40 g/m$^2$ and (ii) the top ply slurry comprises a sufficient amount of microfibrillated cellulose to obtain a product having a top ply comprising at least about 5 wt. % microfibrillated cellulose based on the total weight of top ply; (iii) and the top slurry comprises inorganic particulate material and microfibrillated cellulose. In additional embodiments, the top ply comprises at least about 10 wt. %, at least about 20 wt. %, or up to about 30 wt. %, based on the total weight of the top ply.

According to a fifth aspect, the present invention is directed to the use of a top ply comprising at least about 20 wt. % microfibrillated cellulose, based on the total weight of the top ply, as a white top layer on a paperboard substrate. In additional embodiments, the present invention is directed to the use of a top ply comprising up to about 30 wt. % microfibrillated cellulose, based on the total weight of the top ply, as a white top layer on a paperboard substrate. In certain embodiments the present invention is directed to the use of a top ply comprising inorganic particulate material in the range of about 67 wt. % to about 92 wt. % and microfibrillated cellulose in a range of about 5 wt. % to about 30 wt. % based on the total weight of the top ply.

According to a sixth aspect, the present invention is directed to forming a curtain or film through a non-pressurized or pressurized slot opening on top of a wet substrate on the wire of the wet end of a paper machine to apply a top ply to a substrate to manufacture a paper or paperboard product of the first to third aspects.

In certain additional embodiments, the composite of microfibrillated cellulose and inorganic particulate materials may be applied as a white top layer or other top layer. Advantageously, the process may be performed utilizing low cost equipment for application such as a curtain coater, a pressurized extrusion coater, secondary headbox or pressurize or unpressurized slot coater compared to applying a conventional secondary fibre layer or coating to a dry or semi-dry paper or paperboard product. Moreover, the existing drainage elements and press section of a paper machine such as the drainage table of a Fourdrinier machine may be utilized for water removal. The top ply of microfibrillated cellulose and inorganic particulate material has the ability to stay on top of the substrate and to provide good optical and physical coverage at a low basis weight of the paper or paperboard product.

DETAILED DESCRIPTION OF THE INVENTION

Figure 1:
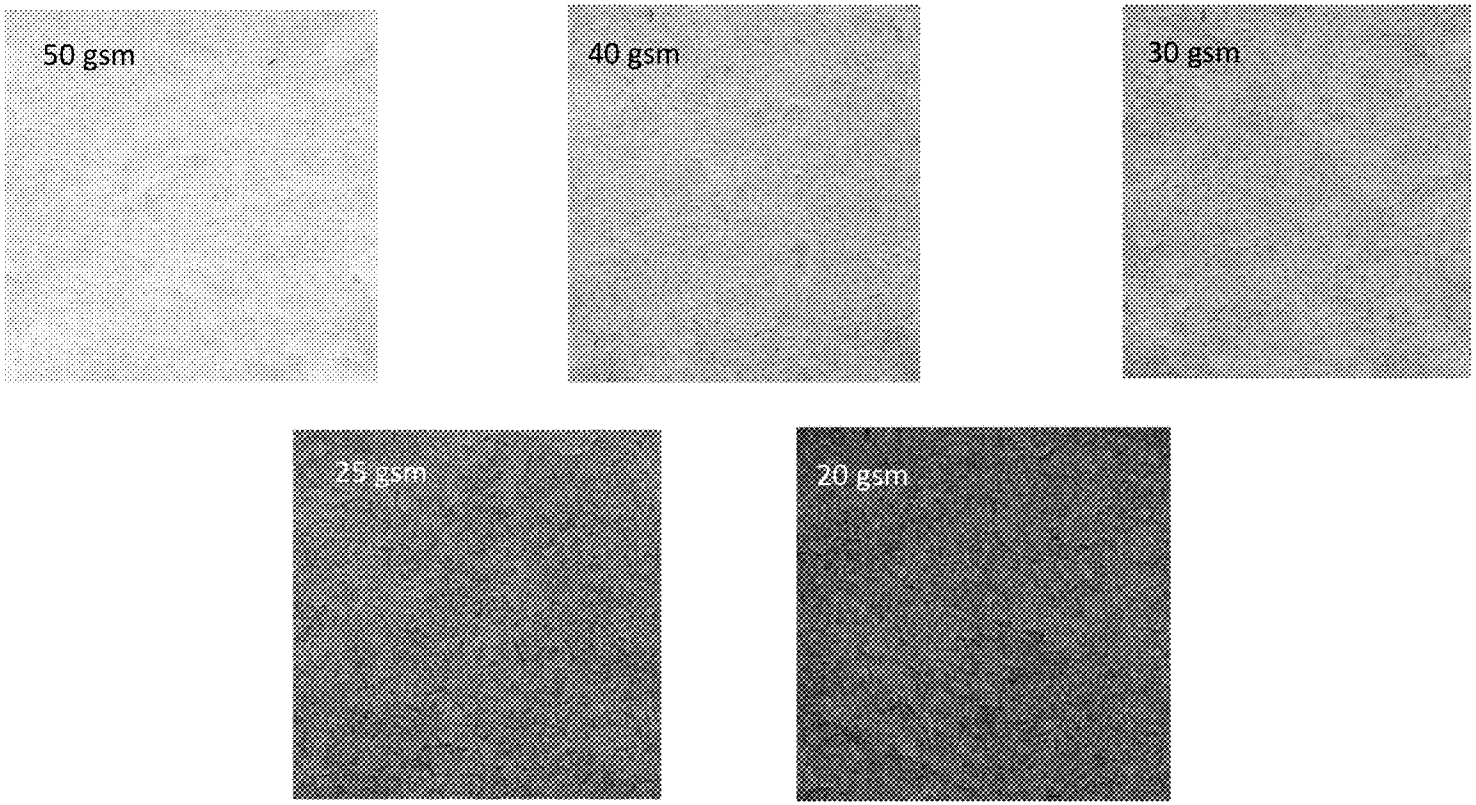
FIG. 1 shows the formation of sheets produced at varying grammage according to Example 1.

It has surprisingly been found that a ply comprising a composite of inorganic particulate material and microfibrillated cellulose can be added onto a paper web in the wet-end of a paper machine (such as a Fourdrinier machine), immediately after the wet line forms and, where the web is still less than 10-15 wt. % solids. The top ply paper or paper board made by the disclosed process provides advantageous optical properties (e.g., brightness) as well as light-weighting and/or surface improvement (e.g., smoothness and low porosity, while maintaining suitable mechanical properties (e.g., strength for end-use applications.

By "top" ply is meant that a top ply is applied on or to the substrate, which substrate may have intermediary plies or layers below the top ply. In certain embodiments, the top ply is an outer ply, i.e., does not have another ply atop. In certain embodiments, the top ply has a grammage of at least about 15 g/m$^2$ to about 40 g/m$^2$.

By "microfibrillated cellulose" is meant a cellulose composition in which microfibrils of cellulose are liberated or partially liberated as individual species or as smaller aggregates as compared to the fibres of a pre-microfibrillated cellulose. The microfibrillated cellulose may be obtained by microfibrillating cellulose, including but not limited to the processes described herein. Typical cellulose fibres (i.e., pre-microfibrillated pulp or pulp not yet fibrillated) suitable for use in papennaking include larger aggregates of hundreds or thousands of individual cellulose microfibrils. By microfibrillating the cellulose, particular characteristics and properties, including but not limited to the characteristics and properties described herein, are imparted to the microfibrillated cellulose and the compositions including the microfibrillated cellulose.

There are numerous types of paper or paperboard possible to be made with the disclosed compositions of microfibrillated cellulose and inorganic particulate materials and by the manufacturing processes described herein. There is no clear demarcation between paper and paperboard products. The latter tend to be thicker paper-based materials with increased grammages. Paperboard may be a single ply, to which the top ply of a composite of microfibrillated cellulose and inorganic particulate material can be applied, or the paperboard may be a multi-ply substrate. The present invention is directed to numerous forms of paperboard, including, by way of example and not limitation, boxboard or cartonboard, including folding cartons and rigid set-up boxes and folding boxboard; e.g. a liquid packaging board. The paperboard may be chipboard or white lined chipboard. The paperboard may be a Kraft board, laminated board. The paperboard may be a solid bleached board or a solid unbleached board. Various forms of containerboard are subsumed within the paperboard products of the present invention such as corrugated fibreboard (which is a building material and not a paper or paperboard product per se), linerboard or a binder's board. The paperboard described herein may be suitable for wrapping and packaging a variety of end-products, including for example foods.

In certain embodiments, the product is or comprises containerboard, and the substrate and top ply are suitable for use in or as containerboard. In certain embodiments, the product is or comprises one of brown Kraft liner, white top Kraft liner, test liner, white top test liner, brown light weight recycled liner, mottled test liner, and white top recycled liner.

In certain embodiments, the product is or comprises cartonboard.

In certain embodiments, the product is or comprises Kraft paper.

In certain embodiments, the substrate comprises a paperboard product or is suitable for use in or as a paperboard product. In certain embodiments, the substrate is suitable for use in a white top paperboard product, for example, as linerboard. In certain embodiments, the product comprises or is a paperboard product, for example, linerboard. In certain embodiments, the product comprises or is a white top paperboard product, for example, linerboard. In such embodiments, the paperboard product may be corrugated board, for example, having the product comprising substrate and top ply as linerboard. In certain embodiments, the paperboard product is single face, single wall, double wall or triple wall corrugated.

Unless otherwise stated, amounts are based on the total dry weight of the top ply and/or substrate.

Unless otherwise stated, particle size properties referred to herein for the inorganic particulate materials are as measured in a well-known manner by sedimentation of the particulate material in a fully dispersed condition in an aqueous medium using a Sedigraph 5100 machine as supplied by Micromeritics Instruments Corporation, Norcross, Ga., USA (telephone: +1 770 662 3620; web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

Alternatively, where stated, the particle size properties referred to herein for the inorganic particulate materials are as measured by the well-known conventional method employed in the art of laser light scattering, using a Malvern Mastersizer S machine as supplied by Malvern Instruments Ltd (or by other methods which give essentially the same result). In the laser light scattering technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the 'equivalent spherical diameter' (e.s.d), less than given e.s.d values. The mean particle size $d_{50}$ is the value determined in this way of the particle e.s.d at which there are 50% by volume of the particles which have an equivalent spherical diameter less than that $d_{50}$ value.

Unless otherwise stated, particle size properties of the microfibrillated cellulose materials are as measured by the well-known conventional method employed in the art of laser light scattering, using a Malvern Mastersizer S machine as supplied by Malvern Instruments Ltd (or by other methods which give essentially the same result).

Details of the procedure used to characterise the particle size distributions of mixtures of inorganic particle material and microfibrillated cellulose using a Malvern Mastersizer S machine are provided below.

Top Ply

In certain embodiments, the top ply comprises at least about 5 wt. % microfibrillated cellulose, based on the total weight of the top ply. In certain embodiments, the top ply comprises from about 5 wt. % to about 30 wt. % microfibrillated cellulose, for example, 5 wt. % to about 25 wt. %, or from about 10 wt. % to about 25 wt. %, or from about 15 wt. % to about 25 wt. %, or from about 17.5 wt. % to about 22.5 wt. % microfibrillated cellulose, based on the total weight of the top ply.

In certain embodiments, the top ply comprises at least about 67 wt. % inorganic particulate material, or at least about 70 wt. % inorganic particulate material, or at least about 75 wt. % inorganic particulate material, or at least about 80 wt. % inorganic particulate material, or at least about 85 wt. % inorganic particulate material, or at least about 90 wt. % inorganic particulate material, based on the total weight of the top ply, and, optionally, from 0 to 3 wt. % of other additives.

In certain embodiments, the microfibrillated cellulose and inorganic particulate material provide a top ply grammage of from about 15 $g/m^2$ to about 40 $g/m^2$. In this and other embodiments, the weight ratio of inorganic particulate to microfibrillated cellulose in the top ply is from about 20:1, or about 10:1, or about 5:1, or about 4:1, or about 3:1 or about 2:1.

In certain embodiments, the top ply comprises from about 70 wt. % to about 90 wt. % inorganic particulate material and from about 10 wt. % to about 30 wt. % microfibrillated cellulose, based on the total weight of the top ply, and optionally up to 3 wt. % of other additives.

In certain embodiments, the top ply is optionally may contain additional organic compound, i.e., organic compound other than microfibrillated cellulose.

In certain embodiments, the top ply is optionally may contain cationic polymer, anionic polymer, and/or polysaccharide hydrocolloid.

In certain embodiments, the top ply is optionally may contain wax, polyolefins, and/or silicone.

In certain embodiments, the top ply is devoid of an optical brightening agent.

In certain embodiments, the top ply consists essentially of inorganic particulate material and microfibrillated cellulose, and as such comprises no more than about 3 wt. %, for example, no more than about 2 wt. %, or no more than about 1 wt. %, or no more than about 0.5 wt. % of additives other than inorganic particulate material and microfibrillated cellulose. In such embodiments, the top ply may comprise up to about 3 wt. % of additives selected from flocculant, formation/drainage aid (e.g., poly(acrylamide-co-diallyldimethylammonium chloride, Polydadmac®), water soluble thickener, starch (e.g., cationic starch), sizing agent, e.g., rosin, alkylketene dimer ("AKD"), alkenylsuccinic anhydride ("ASA") or similar materials and combinations thereof, for example, up to about 2 wt. % of such additives, or up to about 1 wt. % of such additives, or up to about 0.5 wt. % of such additives.

In certain embodiments, we have found that adding small amounts of retention/drainage aids, such as poly(acrylamide-co-diallyldimethylammonium chloride) solution (Polydadmac®), as opposed to much greater amounts used in normal papermaking, the lowered amount of retention aid provides microscale flocculation with no visible negative impact on formation of the substrate, but results in positive impacts on dewatering. This results in significant improvements in dewatering speed.

In certain embodiments, the top ply consists of inorganic particulate material and microfibrillated cellulose, and as such comprises less than about 0.25 wt. %, for example, less than about 0.1 wt. %, or is free of additives other than inorganic particulate material and microfibrillated cellulose, i.e., additives selected from flocculant, formation/drainage aid (e.g., poly(acrylamide-co-diallyldimethylammoniumchloride) solution (Polydadmac®)), water soluble thickener, starch (e.g., cationic starch) and combinations thereof.

The microfibrillated cellulose may be derived from any suitable source.

In certain embodiments, the microfibrillated cellulose has a $d_{50}$ ranging from about 5 μm to about 500 μm, as measured by laser light scattering. In certain embodiments, the microfibrillated cellulose has a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

In certain embodiments, the microfibrillated cellulose has a modal fibre particle size ranging from about 0.1-500 μm. In certain embodiments, the microfibrillated cellulose has a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

Additionally or alternatively, the microfibrillated cellulose may have a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or wollastonite, or titanium dioxide, or magnesium hydroxide, or aluminium trihydrate, lime, graphite, or combinations thereof.

In certain embodiments, the inorganic particulate material comprises or is calcium carbonate, magnesium carbonate, dolomite, gypsum, an anhydrous kandite clay, perlite, diatomaceous earth, wollastonite, magnesium hydroxide, or aluminium trihydrate, titanium dioxide or combinations thereof.

An exemplary inorganic particulate material for use in the present invention is calcium carbonate. Hereafter, the invention may tend to be discussed in terms of calcium carbonate, and in relation to aspects where the calcium carbonate is processed and/or treated. The invention should not be construed as being limited to such embodiments.

The particulate calcium carbonate used in the present invention may be obtained from a natural source by grinding. Ground calcium carbonate (GCC) is typically obtained by crushing and then grinding a mineral source such as chalk, marble or limestone, which may be followed by a particle size classification step, in order to obtain a product having the desired degree of fineness. Other techniques such as bleaching, flotation and magnetic separation may also be used to obtain a product having the desired degree of fineness and/or colour. The particulate solid material may be ground autogenously, i.e. by attrition between the particles of the solid material themselves, or, alternatively, in the presence of a particulate grinding medium comprising particles of a different material from the calcium carbonate to be ground. These processes may be carried out with or without the presence of a dispersant and biocides, which may be added at any stage of the process.

Precipitated calcium carbonate (PCC) may be used as the source of particulate calcium carbonate in the present invention, and may be produced by any of the known methods available in the art. TAPPI Monograph Series No 30, "Paper Coating Pigments", pages 34-35 describes the three main commercial processes for preparing precipitated calcium carbonate which is suitable for use in preparing products for use in the paper industry, but may also be used in the practice of the present invention. In all three processes, a calcium carbonate feed material, such as limestone, is first calcined to produce quicklime, and the quicklime is then slaked in water to yield calcium hydroxide or milk of lime. In the first process, the milk of lime is directly carbonated with carbon dioxide gas. This process has the advantage that no by-product is formed, and it is relatively easy to control the properties and purity of the calcium carbonate product. In the second process the milk of lime is contacted with soda ash to produce, by double decomposition, a precipitate of calcium carbonate and a solution of sodium hydroxide. The sodium hydroxide may be substantially completely separated from the calcium carbonate if this process is used commercially. In the third main commercial process the milk of lime is first contacted with ammonium chloride to give a calcium chloride solution and ammonia gas. The calcium chloride solution is then contacted with soda ash to produce by double decomposition precipitated calcium carbonate and a solution of sodium chloride. The crystals can be produced in a variety of different shapes and sizes, depending on the specific reaction process that is used. The three main forms of PCC crystals are aragonite, rhombohedral and scalenohedral (e.g., calcite), all of which are suitable for use in the present invention, including mixtures thereof.

In certain embodiments, the PCC may be formed during the process of producing microfibrillated cellulose.

Wet grinding of calcium carbonate involves the formation of an aqueous suspension of the calcium carbonate which may then be ground, optionally in the presence of a suitable dispersing agent. Reference may be made to, for example, EP-A-614948 (the contents of which are incorporated by reference in their entirety) for more information regarding the wet grinding of calcium carbonate.

When the inorganic particulate material of the present invention is obtained from naturally occurring sources, it may be that some mineral impurities will contaminate the ground material. For example, naturally occurring calcium carbonate can be present in association with other minerals. Thus, in some embodiments, the inorganic particulate material includes an amount of impurities. In general, however, the inorganic particulate material used in the invention will contain less than about 5% by weight, or less than about 1% by weight, of other mineral impurities.

The inorganic particulate material may have a particle size distribution in which at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% of the particles have an e.s.d of less than 2 μm.

In another embodiment, the inorganic particulate material has a particle size distribution, as measured using a Malvern Mastersizer S machine, in which at least about 10% by volume of the particles have an e.s.d of less than 2 μm, for example, at least about 20% by volume, or at least about 30% by volume, or at least about 40% by volume, or at least about 50% by volume, or at least about 60% by volume, or at least about 70% by volume, or at least about 80% by volume, or at least about 90% by volume, or at least about 95% by volume, or about 100% of the particles by volume have an e.s.d of less than 2 μm.

Details of the procedure used to characterise the particle size distributions of mixtures of inorganic particle material and microfibrillated cellulose using a Malvern Mastersizer S machine are provided below.

In certain embodiments, the inorganic particulate material is kaolin clay. Hereafter, this section of the specification may tend to be discussed in terms of kaolin, and in relation to aspects where the kaolin is processed and/or treated. The invention should not be construed as being limited to such embodiments. Thus, in some embodiments, kaolin is used in an unprocessed form.

Kaolin clay used in this invention may be a processed material derived from a natural source, namely raw natural kaolin clay mineral. The processed kaolin clay may typically contain at least about 50% by weight kaolinite. For example, most commercially processed kaolin clays contain greater than about 75% by weight kaolinite and may contain greater than about 90%, in some cases greater than about 95% by weight of kaolinite.

Kaolin clay used in the present invention may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e.g. by flocculation, flotation, or magnetic separation techniques well known in the art. Alternatively the clay mineral used in the first aspect of the invention may be untreated in the form of a solid or as an aqueous suspension.

The process for preparing the particulate kaolin clay used in the present invention may also include one or more comminution steps, e.g., grinding or milling. Light comminution of a coarse kaolin is used to give suitable delamination thereof. The comminution may be carried out by use of beads or granules of a plastic (e.g. nylon), sand or ceramic grinding or milling aid. The coarse kaolin may be refined to remove impurities and improve physical properties using well known procedures. The kaolin clay may be treated by a known particle size classification procedure, e.g., screening and centrifuging (or both), to obtain particles having a desired $d_{50}$ value or particle size distribution.

The Substrate

The substrate (and the microfibrillated cellulose) may be derived from a cellulose-containing pulp, which may have been prepared by any suitable chemical or mechanical treatment, or combination thereof, which is well known in the art. The pulp may be derived from any suitable source such as wood, grasses (e.g., sugarcane, bamboo) or rags (e.g., textile waste, cotton, hemp or flax). The pulp may be bleached in accordance with processes which are well known to those skilled in the art and those processes suitable for use in the present invention will be readily evident. In certain embodiments, the pulp is unbleached. The bleached or unbleached cellulose pulp may be beaten, refined, or both, to a predetermined freeness (reported in the art as Canadian standard freeness (CSF) in $cm^3$). A suitable stock is then prepared from the bleached or unbleached and beaten pulp.

In certain embodiments, the substrate comprises or is derived from a Kraft pulp, which is naturally (i.e., unbleached) coloured. In certain embodiments, the substrate comprises or is derived from dark Kraft pulp, recycled pulp, or combinations thereof. In certain embodiments, the substrate comprises or is derived from recycled pulp.

The stock from which the substrate is prepared may contain other additives known in the art. For example, the stock contains a non-ionic, cationic or an anionic retention aid or microparticle retention system. It may also contain a sizing agent which may be, for example, a long chain alkylketene dimer ("AKD"), a wax emulsion or a succinic acid derivative, e.g., alkenylsuccinic anhydride ("ASA"), rosin plus alum or cationic rosin emulsions. The stock for the substrate composition may also contain dye and/or an optical brightening agent. The stock may also comprise dry and wet strength aids such as, for example, starch or epichlorhydrin copolymers.

The Product

In certain embodiments, the substrate has a grammage which is suitable for use in or as a containerboard product, for example, a grammage ranging from about 50 $g/m^2$ to about 500 $g/m^2$. In this and other embodiments, the top ply may have a grammage ranging from about 10 $g/m^2$ to about 50 $g/m^2$, particularly about 15 $g/m^2$ to 40 $g/m^2$, and more particularly about 20 $g/m^2$ to 30 $g/m^2$.

In certain embodiments, the substrate has a grammage of from about 75 $g/m^2$ to about 400 $g/m^2$, for example, from about 100 $g/m^2$ to about 375 $g/m^2$, or from about 100 $g/m^2$ to about 350 $g/m^2$, or from about 100 $g/m^2$ to about 300 $g/m^2$, or from about 100 $g/m^2$ to about 275 $g/m^2$, or from about 100 $g/m^2$ to about 250 $g/m^2$, or from about 100 $g/m^2$ to about 225 $g/m^2$, or from about 100 $g/m^2$ to about 200 $g/m^2$. In this and other embodiments, the top ply may have a grammage ranging from about 15 $g/m^2$ to 40 $g/m^2$, or from about 25 $g/m^2$ to 35 $g/m^2$.

In certain embodiments, the top ply has a grammage which is equal to or less than 40 g/m$^2$, or equal to or less than about 35 g/m$^2$, or equal to or less than about 30 g/m$^2$, or equal to or less than 25 g/m$^2$, or equal to or less than 22.5 g/m$^2$, or equal to or less than 20 g/m$^2$, or equal to or less than 18 g/m$^2$, or equal to or less than 15 g/m$^2$.

In certain embodiments, the top ply has a grammage which is equal to or less than 40 g/m$^2$, or equal to or less than about 35 g/m$^2$, or equal to or less than about 30 g/m$^2$, or equal to or less than 25 g/m$^2$, or equal to or less than 22.5 g/m$^2$, or equal to or less than 20 g/m$^2$, or equal to or less than 18 g/m$^2$, or equal to or less than 15 g/m$^2$.

Advantageously, the application of a top ply comprising inorganic particulate material and microfibrillated cellulose enables manufacture of a product, for example, paperboard or containerboard, having a combination of desirable optical, surface and mechanical properties, which are obtainable while utilising relatively low amounts of a top ply having a high filler content, thereby offering light-weighting of the product compared to conventional top ply/substrate configurations. Further, any reduction in mechanical properties which may occur following application of the top ply may be offset by increasing the grammage of the substrate, which is a relatively cheaper material.

Therefore, in certain embodiments, the product has one or more of the following:

(i) a brightness measured (according to ISO Standard 11475 (F8; D65-400 nm)) on the top ply which is increased compared to the substrate absent of the top ply or measured on the substrate on a surface opposite the top ply and/or a brightness measured on the top ply of a least about 60.0% according to ISO Standard 11475 (F8; D65-400 nm);

(ii) a PPS roughness (@1000 kPa) measured on the top ply of no more than about 6.0 μm and/or a PPS roughness (@1000 kPa) measured on the top ply which is at least 2.0 μm less than the PPS roughness of the substrate absent the top ply.

In certain embodiments, a brightness measured on the top ply is at least about 70.0%, for example, at least about 75.0%, or at least about 80.0%, or at least about 81.0%, or at least about 82.0%, or at least about 83.0%, or at least about 84.0%, or at least about 85.0%. Brightness may be measured using an Elrepho spectrophotometer.

In certain embodiments, the product has a PPS roughness (@1000 kPa) measured on the top ply of less than about 5.9 μm, for example, less than about 5.8 μm, or less than about 5.7 μm, or less than about 5.6 μm, or less than about 5.5 μm. In certain embodiments, the PPS roughness is from about 5.0 μm to about 6.0 μm, for example, from about 5.2 μm to about 6.0 μm, or from about 5.2 μm to about 5.8 μm, or from about 5.2 μm to about 5.6 μM.

In certain embodiments, the top ply has a grammage of from about 30 to 50 g/m$^2$, a brightness of at least about 65.0%, and, optionally, a PPS roughness of less than about 5.6 μm.

In certain embodiments, the product comprises a further layer or ply, or further layers or plies, on the ply comprising at least about 50 wt. % microfibrillated cellulose. For example, one or more layers or plies, or at least two further layers or plies, or up to about five further layers or plies, or up to about four further layers or plies, or up to about three further layers or plies.

In certain embodiments, one of, or at least one of the further layers or plies is a barrier layer or ply, or wax layer or ply, or silicon layer or ply, or a combination of two or three of such layers.

Another advantageous feature of the disclosed top ply coated substrates comprising microfibrillated cellulose and inorganic particulate material is improved printing on the top ply. A conventional white top liner typically has a white surface consisting of a white paper with relatively low filler content, typically in the 5-15% filler range. As a result, such white top liners tend to be quite rough and open with a coarse pore structure. This is not ideal for receiving printing ink.

Figure 6:
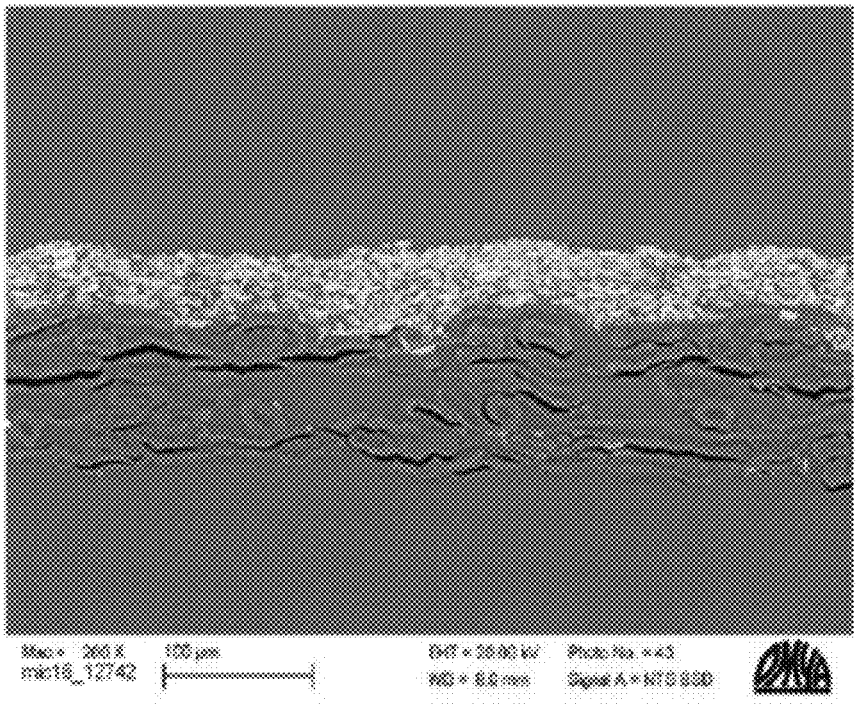
FIG. 6 is a scanning electron microscopic image of a substrate coated with a 48 g/m$^2$ of a top ply comprising 20% wt. % microfibrillated cellulose, 20 wt. % ground calcium carbonate and 60 wt. % talc applied to a 85 g/m$^2$ substrate at trial point T4.

FIG. 6 below illustrates the printing improvements realized by application of the top ply of the present invention comprising microfibrillated cellulose and organic particulate material. Overall, the use of such a ply may provide a 'greener' packaging product because the low porosity of the ply may allow for improved properties in barrier applications that enable non-recyclable wax, PE and silicon, etc., coatings to be replaced by recyclable formulations, to obtain an overall equal or improved performance from the non-recyclable counterparts.

Methods of Manufacture

A method of making a paper product is provided. It comprises:

(a) providing a wet web of pulp; and (b) providing a top ply slurry onto the wet web of pulp.

The top ply slurry (i) is provided in an amount ranging from 15 g/m$^2$ to 40 g/m$^2$; and (ii) the top ply slurry comprises a sufficient amount of microfibrillated cellulose to obtain a product having a top ply comprising at least about 5 wt. % microfibrillated cellulose and (iii) the top ply slurry comprises at least about 67 wt. % inorganic particulate material.

This method is a 'wet on wet' method which is different than conventional paper coating methods in which an aqueous coating is applied to a substantially dry paper product (i.e., 'wet on dry').

In certain embodiments, the top slurry is provided in an amount ranging from 15 g/m$^2$ to 40 g/m$^2$.

In certain embodiments, the top ply slurry comprises a sufficient amount of microfibrillated cellulose to obtain a product having the strength properties required for meeting end-use demands. Typically this would mean a top ply comprising at least about 5 wt. % microfibrillated cellulose, based on the total weight of top ply (i.e., the total dry weight of the top ply of the paper product).

The top ply slurry may be applied by any suitable application method. In an embodiment, the top ply slurry is applied through a non-pressurized or pressurized slot applicator having an opening positioned on top of a wet substrate on the wire of the wet end of a paper machine. Examples of known applicators which may be employed include, without limitation, air knife coaters, blade coaters, rod coaters, bar coaters, multi-head coaters, roll coaters, roll or blade coaters, cast coaters, laboratory coaters, gravure coaters, kiss-coaters, slot die applicators (including, e.g. non-contact metering slot die applicators jet coaters, liquid application systems, reverse roll coaters, headbox, secondary headbox, curtain coaters, spray coaters and extrusion coaters.

In certain embodiments, the top ply slurry is applied using a curtain coater. Further, in certain embodiments in which the top ply slurry is applied as white top liner layer, the use of a curtain coater may eliminate the need for a twin headbox paper machine and the associated cost and energy.

In certain embodiments, the top ply slurry is applied by spraying, e.g., using a spray coater.

Use of high solids compositions is desirable in the method because it leaves less water to drain. However, as is well known in the art, the solids level should not be so high that high viscosity and leveling problems are introduced.

The methods of application may be performed using a suitable applicator such as an air knife coater, blade coater, rod coater, bar coater, multi-head coater, roll coater, roll or blade coater, cast coater, laboratory coater, gravure coater, kisscoater, slot die applicator (including, e.g. a non-contact metering slot die applicator and a non-pressurized or pressurized slot applicator), jet coater, liquid application system, reverse roll coater, headbox, secondary headbox, curtain coater, spray coater or an extrusion coater, to apply the top ply slurry to the substrate.

In an embodiment, the top ply slurry is applied a coating to the substrate by a non-pressurized or pressurized slot opening on top of the wet substrate on the wire of the wet end of a paper machine, for example a Fourdrinier machine.

In certain embodiments, the wet web of pulp comprises greater than about 50 wt. % of water, based on the total weight of the wet web of pulp, for example, at least about 60 wt. %, or at least about 70 wt. %, or at least about 80 wt. %, or at least about 90 wt. % of water, based on the total weight of the wet web of pulp. Typically, the wet web of pulp comprises about 85-95 wt. % water.

In certain embodiments, the top ply slurry comprises inorganic particulate material and a sufficient amount of microfibrillated cellulose to obtain a paper product having a top ply comprising at least about 5 wt. % microfibrillated cellulose, based on the total weight of the top ply and such that the paper product has sufficient microfibrillated cellulose to obtain a paper product with the strength properties needed for its end-use application. In certain embodiments, the top ply slurry comprises a sufficient amount of inorganic particulate material to obtain a paper product having a top ply comprising at least about 67 wt. % of inorganic particulate material, based on the total weight of the top ply of the paper product. In such embodiments the objective is to incorporate as little microfibrillated cellulose with as much inorganic particulate material as possible on the surface of the substrate material as a top layer. Accordingly, ratios of 4:1 or greater of inorganic particulate material to microfibrillated cellulose in the top ply are preferred.

In certain embodiments, the top ply slurry has a total solids content of up to about 20 wt. %, for example, up to about 15 wt. %, or up to 12 wt. %, or up to about 10 wt. %, or from about 1 wt. % to about 10 wt. %, or from about 2 wt. % to 12 wt. %, or from about 5 wt. % to about 10 wt. %, or from about 1 wt. % to about 20 wt. %, or from about 2 wt. % to about 12 wt. %. The relative amounts of inorganic particulate material and microfibrillated cellulose may be varied depending on the amount of each component required in the final product.

Following application of the top ply slurry and appropriate dwell time, the paper product is pressed and dried using any suitable method.

Methods of Manufacturing Microfibrillated Cellulose and Inorganic Particulate Material In certain embodiments, the microfibrillated cellulose may be prepared in the presence of or in the absence of the inorganic particulate material.

The microfibrillated cellulose is derived from fibrous substrate comprising cellulose. The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemi-thermomechanical pulp, or a mechanical pulp, or a recycled pulp, or a papermill broke, or a papermill waste stream, or waste from a papermill, or a dissolving pulp, kenaf pulp, market pulp, partially carboxymethylated pulp, abaca pulp, hemlock pulp, birch pulp, grass pulp, bamboo pulp, palm pulp, peanut shell, or a combination thereof. The cellulose pulp may be beaten (for example, in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$.

The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state, which is to say without being beaten or dewatered, or otherwise refined.

In certain embodiments, the pulp may be beaten in the presence of an inorganic particulate material, such as calcium carbonate.

For preparation of microfibrillated cellulose, the fibrous substrate comprising cellulose may be added to a grinding vessel or homogenizer in a dry state. For example, a dry paper broke may be added directly to a grinder vessel. The aqueous environment in the grinder vessel will then facilitate the formation of a pulp.

The step of microfibrillating may be carried out in any suitable apparatus, including but not limited to a refiner. In one embodiment, the microfibrillating step is conducted in a grinding vessel under wet-grinding conditions. In another embodiment, the microfibrillating step is carried out in a homogenizer. Each of these embodiments is described in greater detail below.

wet-grinding

The grinding is suitably performed in a conventional manner. The grinding may be an attrition grinding process in the presence of a particulate grinding medium, or may be an autogenous grinding process, i.e., one in the absence of a grinding medium. By grinding medium is meant to be a medium other than the inorganic particulate material which in certain embodiments may be co-ground with the fibrous substrate comprising cellulose.

The particulate grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C.

For example, in some embodiments a Carbolite® grinding media is used. Alternatively, particles of natural sand of a suitable particle size may be used.

In other embodiments, hardwood grinding media (e.g., wood flour) may be used.

Generally, the type of and particle size of grinding medium to be selected for use in the invention may be dependent on the properties, such as, e.g., the particle size of, and the chemical composition of, the feed suspension of material to be ground. In some embodiments, the particulate grinding medium comprises particles having an average diameter in the range of from about 0.1 mm to about 6.0 mm, for example, in the range of from about 0.2 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The grinding may be carried out in one or more stages. For example, a coarse inorganic particulate material may be ground in the grinder vessel to a predetermined particle size distribution, after which the fibrous material comprising cellulose is added and the grinding continued until the desired level of microfibrillation has been obtained.

The inorganic particulate material may be wet or dry ground in the absence or presence of a grinding medium. In the case of a wet grinding stage, the coarse inorganic particulate material is ground in an aqueous suspension in the presence of a grinding medium.

In one embodiment, the mean particle size ($d_{50}$) of the inorganic particulate material is reduced during the co-grinding process. For example, the $d_{50}$ of the inorganic particulate material may be reduced by at least about 10% (as measured by a Malvern Mastersizer S machine), for example, the $d_{50}$ of the inorganic particulate material may be reduced by at least about 20%, or reduced by at least about 30%, or reduced by at least about 50%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size.

In certain embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5%.

The fibrous substrate comprising cellulose may be microfibrillated, optionally in the presence of an inorganic particulate material, to obtain microfibrillated cellulose having a $d_{50}$ ranging from about 5 to μm about 500 μm, as measured by laser light scattering. The fibrous substrate comprising cellulose may be microfibrillated, optionally in the presence of an inorganic particulate material, to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μm, or equal to or less than about 40 μm, or equal to or less than about 30 μm, or equal to or less than about 20 μm, or equal to or less than about 10 μm.

The fibrous substrate comprising cellulose may be microfibrillated, optionally in the presence of an inorganic particulate material, to obtain microfibrillated cellulose having a modal fibre particle size ranging from about 0.1-500 μm and a modal inorganic particulate material particle size ranging from 0.25-20 μm. The fibrous substrate comprising cellulose may be microfibrillated, optionally in the presence of an inorganic particulate material to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μM.

The fibrous substrate comprising cellulose may be microfibrillated, optionally in the presence of an inorganic particulate material, to obtain microfibrillated cellulose having a fibre steepness, as described above.

The grinding may be performed in a grinding vessel, such as a tumbling mill (e.g., rod, ball and autogenous), a stirred mill (e.g., SAM or Isa Mill), a tower mill, a stirred media detritor (SMD), or a grinding vessel comprising rotating parallel grinding plates between which the feed to be ground is fed.

In one embodiment, the grinding vessel is a tower mill. The tower mill may comprise a quiescent zone above one or more grinding zones. A quiescent zone is a region located towards the top of the interior of tower mill in which minimal or no grinding takes place and comprises microfibrillated cellulose and optional inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grind zones. In an embodiment, a screen is located adjacent to a quiescent zone and/or a classifier. The screen may be sized to separate grinding media from the product aqueous suspension comprising microfibrillated cellulose and optional inorganic particulate material and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose and optional inorganic particulate material at those zones in the mill. By diluting the product microfibrillated cellulose and optional inorganic particulate material at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose and optional inorganic particulate material may be added. The water may be added continuously during the grinding process, or at regular intervals, or at irregular intervals.

In another embodiment, water may be added to one or more grinding zones via one or more water injection points positioned along the length of the tower mill, or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, such as a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm.

The screen sizes noted immediately above are applicable to the tower mill embodiments described above.

As noted above, the grinding may be performed in the presence of a grinding medium. In an embodiment, the grinding medium is a coarse media comprising particles having an average diameter in the range of from about 1 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

In another embodiment, the grinding media comprises particles having an average diameter in the range of from about 1 mm to about 6 mm and has a specific gravity of at least about 2.5.

In another embodiment, the grinding media comprises particles having an average diameter of about 3 mm and specific gravity of about 2.7.

As described above, the grinding medium (or media) may present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

The term 'charge' is meant to be the composition which is the feed fed to the grinder vessel. The charge includes of water, grinding media, fibrous substrate comprising cellulose and optional inorganic particulate material, and any other optional additives as described herein.

The use of a relatively coarse and/or dense media has the advantage of improved (i.e., faster) sediment rates and reduced media carry over through the quiescent zone and/or classifier and/or screen(s).

A further advantage in using relatively coarse grinding media is that the mean particle size ($d_{50}$) of the inorganic particulate material may not be significantly reduced during the grinding process such that the energy imparted to the grinding system is primarily expended in microfibrillating the fibrous substrate comprising cellulose.

A further advantage in using relatively coarse screens is that a relatively coarse or dense grinding media can be used in the microfibrillating step. In addition, the use of relatively coarse screens (i.e., having a nominal aperture of least about 250 μm) allows a relatively high solids product to be processed and removed from the grinder, which allows a relatively high solids feed (comprising fibrous substrate comprising cellulose and inorganic particulate material) to be processed in an economically viable process. As discussed below, it has been found that a feed having high initial solids content is desirable in terms of energy sufficiency. Further, it has also been found that product produced (at a given energy) at lower solids has a coarser particle size distribution.

The grinding may be performed in a cascade of grinding vessels, one or more of which may comprise one or more grinding zones. For example, the fibrous substrate comprising cellulose and the inorganic particulate material may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively linked in series or parallel or a combination of series and parallel. The output from and/or the input to one or more of the grinding vessels in the cascade may be subjected to one or more screening steps and/or one or more classification steps.

The circuit may comprise a combination of one or more grinding vessels and homogenizer.

In an embodiment the grinding is performed in a closed circuit. In another embodiment, the grinding is performed in an open circuit. The grinding may be performed in batch mode. The grinding may be performed in a re-circulating batch mode.

As described above, the grinding circuit may include a pre-grinding step in which coarse inorganic particulate ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may be added to the suspension prior to grinding. The dispersing agent may be, for example, a water soluble condensed phosphate, polysilicic acid or a salt thereof, or a polyelectrolyte, for example a water soluble salt of a poly(acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, oxidising agents, 2,2,6,6-Tetramethylpiperidine-1-oxyl (TEMPO), TEMPO derivatives, and wood degrading enzymes.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example, NaOH. Other suitable bases are sodium carbonate and ammonia. Suitable acids included inorganic acids, such as hydrochloric and sulphuric acid, or organic acids. An exemplary acid is orthophosphoric acid.

The amount of inorganic particulate material, when present, and cellulose pulp in the mixture to be co-ground may be varied in order to produce a slurry which is suitable for use as the top ply slurry, or ply slurry, or which may be further modified, e.g., with additional of further inorganic particulate material, to produce a slurry which is suitable for use as the top ply slurry, or ply slurry.

homogenizing

Microfibrillation of the fibrous substrate comprising cellulose may be effected under wet conditions, optionally, in the presence of the inorganic particulate material, by a method in which the mixture of cellulose pulp and optional inorganic particulate material is pressurized (for example, to a pressure of about 500 bar) and then passed to a zone of lower pressure. The rate at which the mixture is passed to the low pressure zone is sufficiently high and the pressure of the low pressure zone is sufficiently low as to cause microfibrillation of the cellulose fibres. For example, the pressure drop may be effected by forcing the mixture through an annular opening that has a narrow entrance orifice with a much larger exit orifice. The drastic decrease in pressure as the mixture accelerates into a larger volume (i.e., a lower pressure zone) induces cavitation which causes microfibrillation. In an embodiment, microfibrillation of the fibrous substrate comprising cellulose may be effected in a homogenizer under wet conditions, optionally in the presence of the inorganic particulate material. In the homogenizer, the cellulose pulp and optional inorganic particulate material is pressurized (for example, to a pressure of about 500 bar), and forced through a small nozzle or orifice. The mixture may be pressurized to a pressure of from about 100 to about 1000 bar, for example to a pressure of equal to or greater than 300 bar, or equal to or greater than about 500, or equal to or greater than about 200 bar, or equal to or greater than about 700 bar. The homogenization subjects the fibres to high shear forces such that as the pressurized cellulose pulp exits the nozzle or orifice, cavitation causes microfibrillation of the cellulose fibres in the pulp. Additional water may be added to improve flowability of the suspension through the homogenizer. The resulting aqueous suspension comprising microfibrillated cellulose and optional inorganic particulate material may be fed back into the inlet of the homogenizer for multiple passes through the homogenizer. When present, and when the inorganic particulate material is a naturally platy mineral, such as kaolin, homogenization not only facilitates microfibrillation of the cellulose pulp, but may also facilitate delamination of the platy particulate material.

An exemplary homogenizer is a Manton Gaulin (APV) homogenizer.

After the microfibrillation step has been carried out, the aqueous suspension comprising microfibrillated cellulose and optional inorganic particulate material may be screened to remove fibre above a certain size and to remove any grinding medium. For example, the suspension can be subjected to screening using a sieve having a selected nominal aperture size in order to remove fibres which do not pass through the sieve. Nominal aperture size means the nominal central separation of opposite sides of a square aperture or the nominal diameter of a round aperture. The sieve may be a BSS sieve (in accordance with BS 1796) having a nominal aperture size of 150 μm, for example, a nominal aperture size 125 μm, or 106 μm, or 90 μm, or 74 μm, or 63 μm, or 53 μm, 45 μm, or 38 μm. In one embodiment, the aqueous suspension is screened using a BSS sieve having a nominal aperture of 125 μm. The aqueous suspension may then be optionally dewatered.

It will be understood therefore that amount (i.e., % by weight) of microfibrillated cellulose in the aqueous suspension after grinding or homogenizing may be less than the amount of dry fibre in the pulp if the ground or homogenized suspension is treated to remove fibres above a selected size. Thus, the relative amounts of pulp and optional inorganic particulate material fed to the grinder or homogenizer can be adjusted depending on the amount of microfibrillated cellulose that is required in the aqueous suspension after fibres above a selected size are removed.

In certain embodiments, the microfibrillated cellulose may be prepared by a method comprising a step of microfibrillating the fibrous substrate comprising cellulose in an aqueous environment by grinding in the presence of a grinding medium (as described herein), wherein the grinding is carried out in the absence of inorganic particulate material.

In certain embodiments, inorganic particulate material may be added after grinding to produce the top ply slurry, or ply slurry.

In certain embodiments, the grinding medium is removed after grinding.

In other embodiments, the grinding medium is retained after grinding and may serve as the inorganic particulate material, or at least a portion thereof. In certain embodiments, additional inorganic particulate may be added after grinding to produce the top ply slurry, or ply slurry.

The following procedure may be used to characterise the particle size distributions of mixtures of inorganic particulate material (e.g., GCC or kaolin) and microfibrillated cellulose pulp fibres.

calcium carbonate

A sample of co-ground slurry sufficient to give 3 g dry material is weighed into a beaker, diluted to 60 g with deionised water, and mixed with 5 $cm^3$ of a solution of sodium polyacrylate of 1.5 w/v % active. Further deionised water is added with stirring to a final slurry weight of 80 g.

kaolin

A sample of co-ground slurry sufficient to give 5 g dry material is weighed into a beaker, diluted to 60 g with deionised water, and mixed with 5 $cm^3$ of a solution of 1.0 wt. % sodium carbonate and 0.5 wt. % sodium hexametaphosphate. Further deionised water is added with stirring to a final slurry weight of 80 g.

The slurry is then added in 1 $cm^3$ aliquots to water in the sample preparation unit attached to the Mastersizer S until the optimum level of obscuration is displayed (normally 10-15%). The light scattering analysis procedure is then carried out. The instrument range selected was 300RF: 0.05-900, and the beam length set to 2.4 mm.

For co-ground samples containing calcium carbonate and fibre the refractive index for calcium carbonate (1.596) is used. For co-ground samples of kaolin and fibre the RI for kaolin (1.5295) is used.

The particle size distribution is calculated from Mie theory and gives the output as a differential volume based distribution. The presence of two distinct peaks is interpreted as arising from the mineral (finer peak) and fibre (coarser peak).

The finer mineral peak is fitted to the measured data points and subtracted mathematically from the distribution to leave the fibre peak, which is converted to a cumulative distribution. Similarly, the fibre peak is subtracted mathematically from the original distribution to leave the mineral peak, which is also converted to a cumulative distribution. Both these cumulative curves may then be used to calculate the mean particle size ($d_{50}$) and the steepness of the distribution ($d_{30}/d_{70}\times100$). The differential curve may be used to find the modal particle size for both the mineral and fibre fractions.

EXAMPLES

Example 1

1. A 150 $g/m^2$ brown sheet was produced in a handsheet former. Percol® 292 was used as retention aid at 600 ppm based on the total solids of the final handsheets.
2. Once the brown sheet was formed some of the retained water was removed by manually pressing the sheet with three blotted papers. No adhesion was observed between the blotters and the sheet.
3. The brown base sheet was then turned upside down in order for the smoother side of it to be on the top.
4. A specific amount of microfibrillated Botnia Pine and Bleached Kraft Pulp and calcium carbonate (Intracarb 60) at total solids content of 7.88 wt. % (18% microfibrillated cellulose) was measured in order to get the desired grammage for the white top layer (sheets were prepared at 20 $g/m^2$, 25 $g/m^2$, 30 $g/m^2$, 40 $g/m^2$ and 50 $g/m^2$). The microfibrillated cellulose/calcium carbonate sample was then diluted to a final volume of 300 ml using tap water.
5. The sample was poured on the brown sheet and a vacuum was applied. Polydadmac (1 ml of a 0.2% solution) was used to aid the formation of the white top layer.
6. The discarded water was then collected and added back to the formed sheet where vacuum was applied for 1 minute.
7. The two ply sheet was transferred to the Rapid Kothen dryer (−89° C., 1 bar) for 15 minutes.
8. The sample that remained in the residue water (see step 6) was collected on a filter paper and used to calculate the actual grammage of the white top layer for each individual sheet.
9. Each sheet was then left overnight in a conditioned lab before testing.

Results:

The formation of the sheets produced at varying grammage is shown in FIG. 1. The pictures were obtained with reflectance scanning using a regular scanner under the same conditions so they can be directly compared to each other.

Figure 2:
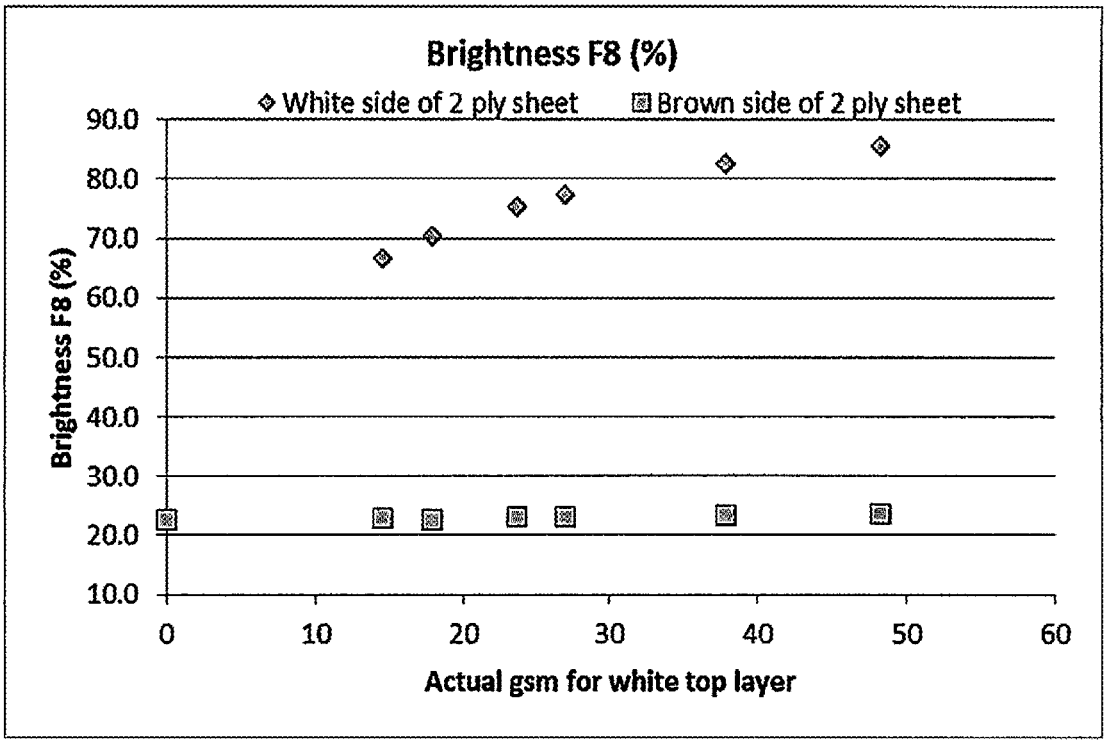
FIG. 2 is a graph summarizing the brightness of sheets produced at varying grammage according to Example 1.

The brightness of the sheets produced is shown in FIG. 2. Brightness increased with increasing $g/m^2$ of the white top liner. Brightness measurement of the brown side of the two ply sheets indicated that no penetration of the white top layer through the brown sheet had occurred.

Figure 3:
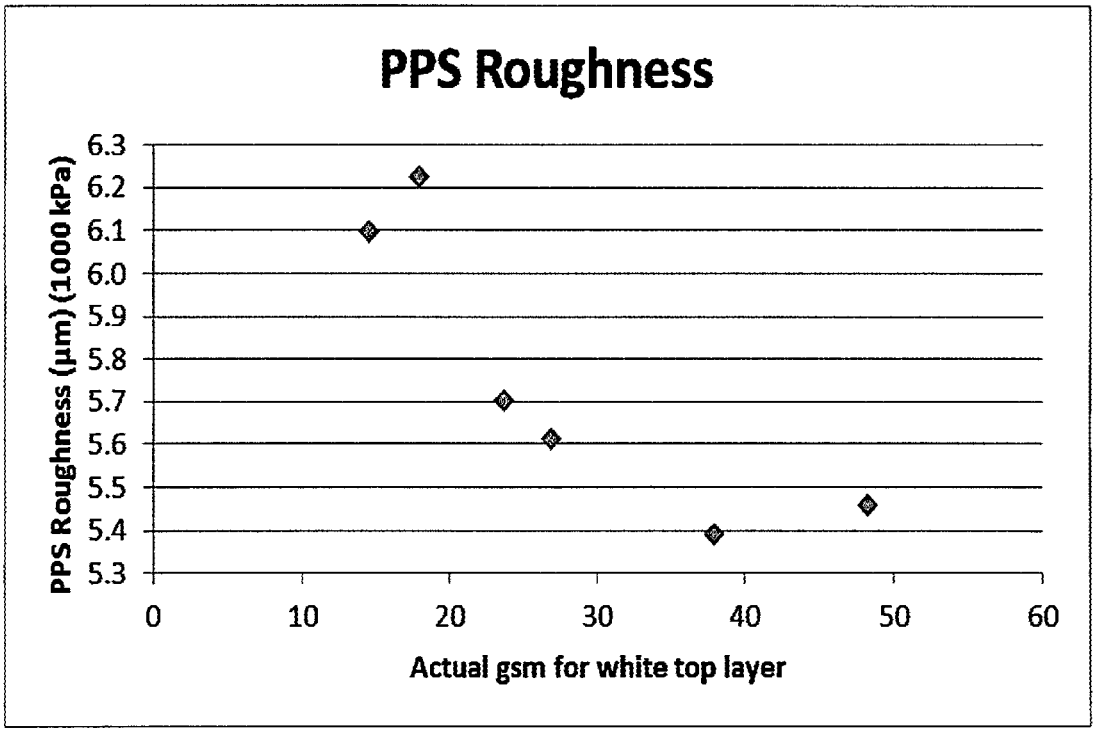
FIG. 3 is a graph summarizing PPS Roughness of sheets produced at varying grammage according to Example 1.

PPS Roughness decreased with higher grammages of the white top layer (see FIG. 3). The roughness value for the brown sheet alone was 7.9 μm. This shows that the surface gets smoother with increased grammage of the top layer.

Example 2

Trials 1-4

The Fourdrinier machine was run at 60 ft/min (18 m/min) A 'secondary headbox' was used to apply the coating. This was a custom-made device in which the furnish flows into a series of 'ponds' and then over a weir and onto the web. The custom secondary headbox does not require as high a flowrate as a GL & V Hydrasizer in order to form a curtain, and so it was possible to increase the microfibrillated cellulose and inorganic particulate material solids used and still achieve the target coat weights. Working at higher solids meant that the secondary headbox could be positioned further from the main headbox, at a position where the sheet was more consolidated, and yet the microfibrillated cellulose and inorganic particulate material slurry applied as a top ply could still be adequately dewatered before the press.

With the secondary headbox in place a short distance after the wet-line a 1:1 ratio of microfibrillated cellulose to organic particulate material was applied in order to explore boundaries of the process. It was apparent that the 1:1 ratio of microfibrillated cellulose to organic particulate material slurry drained faster than the 1:4 ratio of microfibrillated cellulose to organic particulate material, even though the grammage of the microfibrillated cellulose being applied to the substrate was higher. The coating was applied initially at 15 $g/m^2$, then gradually increased to 30 $g/m^2$ without problems. Although the coverage was good, at 1:1 ratio of microfibrillated cellulose to organic particulate material, the filler content was not high enough to yield the desired brightness.

The calculation of top layer $g/m^2$ from sheet weight and ash content was done in the following manner.

W=weight, A=ash content

Subscripts t=top layer, b=bottom layer, s=two-layer sheet.

The total ash of the sheet is the sum of the products of ash content and weight of each layer, divided by the overall sheet weight.

$$A_s = \frac{W_t \times A_t + W_b \times A_b}{W_s}$$

The ash content of the bottom layer is measured on the uncoated control sheet, and the ash content of the top layer is directly related to the wt. % of the microfibrillated and inorganic particulate matter slurry. Because observation of the sheet and the SEM cross sections show that no penetration of the top ply slurry composite of microfibrillated and inorganic particulate matter into the base occurs that 100% retention is achieved. The weight of the bottom layer can be eliminated from the above equation because $$W_b = W_s - W_t$$

and, thus, it can be re-arranged to give the weight of the top layer in terms of known quantities.

$$W_t = W_s \times \frac{(A_s - A_b)}{(A_t - A_b)}$$

Trials 1-4

A series of additional trials were run with the set-up used in Trial 1. The Fourdrinier paper machine was utilized with different coat weights on top of a 100% softwood unbleached kraft base refined to about 500 ml CSF. Top ply consisting of 20% microfibrillated cellulose, 80% mineral and a small amount of flocculant.

Results:

The results are reported in Table 1. The following abbreviations are utilized in Table 1.

BP: Base paper without coating

T1: Ca 28 g/m$^2$ composite top coating, 20% microfibrillated cellulose, 80% GCC.

T2: Ca 35 g/m$^2$ composite top coating, 20% microfibrillated cellulose, 80% GCC.

T3: Ca 42 g/m$^2$ composite top coating, 20% microfibrillated cellulose, 80% GCC.

T4: Ca 48 g/m$^2$ composite top coating, 20% microfibrillated cellulose, 20% GCC, 60% talc.

TABLE 1

| | BP | T1 | T2 | T3 | T4 |
|---|---|---|---|---|---|
| Coat weight (g/m$^2$) | — | 28.4 | 34.6 | 42.1 | 48.3 |
| F8 Brightness (%) | 15.2 | 74.3 | 78.4 | 81.2 | 79.4 |
| Bendtsen Porosity (ml/min) | 1939 | 66 | 33 | 30 | 47 |
| Bendtsen Smoothness (ml/min) | 1585 | 517 | 520 | 448 | 289 |
| Scott Bond (J/m$^2$) | 199 | 194 | 183 | 207 | 215 |
| Burst strength (KPa) | 265 | 300 | 325 | 314 | 353 |
| SCT Index CD (Nm/g) | 11.4 | 10.5 | 11.0 | 10.4 | 10.8 |
| SCT Index MD (Nm/g) | 22.4 | 18.5 | 19.1 | 18.4 | 19.0 |
| Tensile Index CD (Nm/g) | 26.5 | 22.3 | 19.3 | 17.5 | 19.4 |
| Tensile Index MD (Nm/g) | 79.5 | 60.7 | 63.7 | 59.0 | 58.2 |

Figure 4:
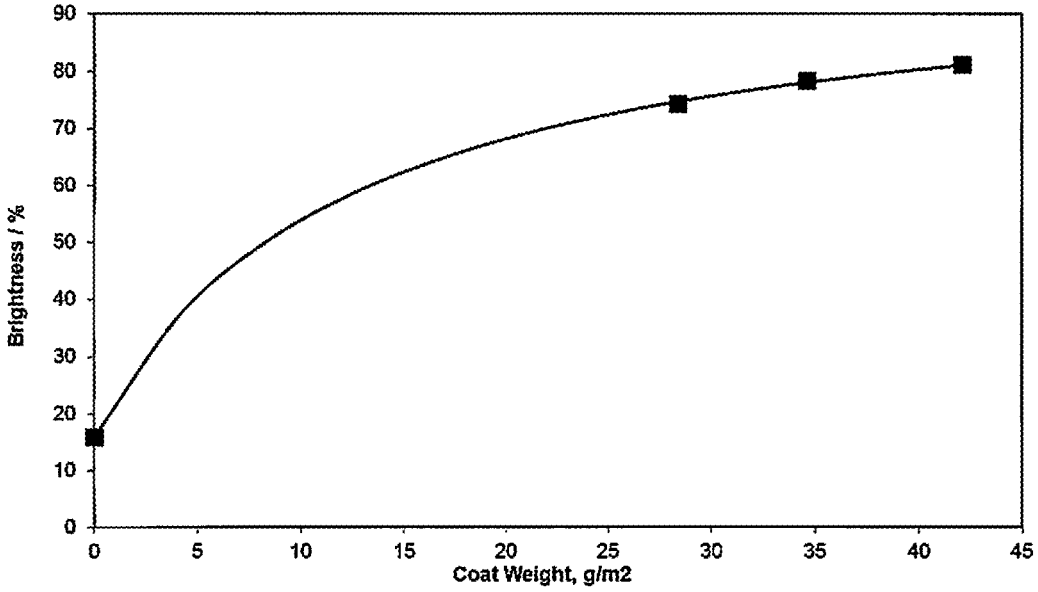
FIG. 4 is a plot of brightness versus coating weight levels for Trials 1-4 of Example 2.

The trials show that the results on brightness, porosity and smoothness at various coat weights ranging from 28 g/m$^2$ to 48 g/m$^2$. There was no impact on Scott Bond as the break in the z-directional strength test always occurred in the base sheet, i.e., the top ply was stronger than the base. Brightness vs. coat weight is plotted in FIG. 4.

Figure 5:
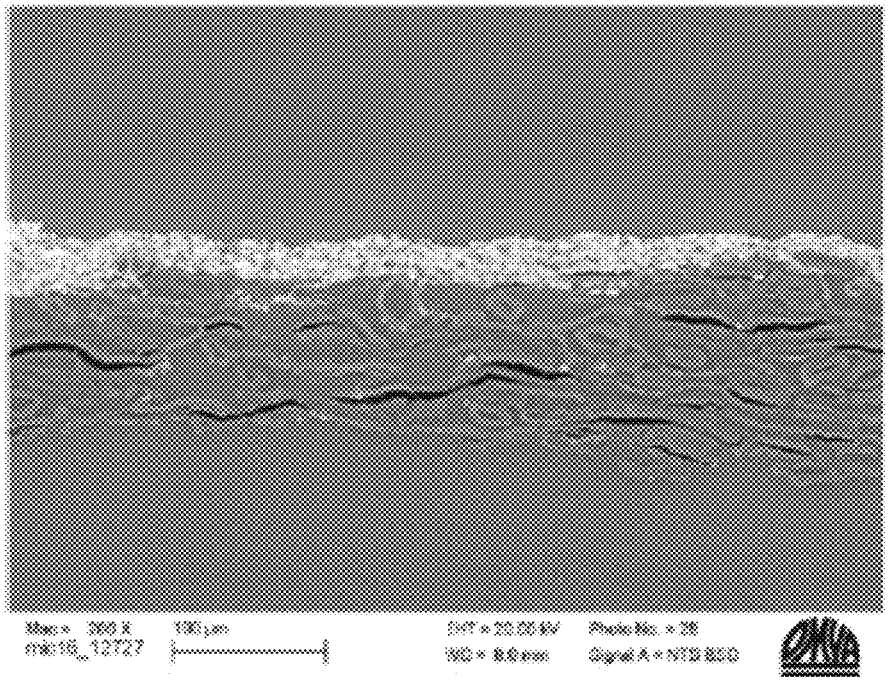
FIG. 5 is a scanning electron microscope image of a substrate coated with a 35 g/m$^2$ top ply comprising 20 wt. % microfibrillated cellulose and 80 wt. % ground calcium carbonate applied to a 85 g/m$^2$ substrate at trial point T2.

Scanning electronic microscopic imaging of a coated substrate at point T2 is depicted in FIG. 5. The top ply was applied at 35 g/m$^2$ consisting of 20% wt. % microfibrillated cellulose and 80 wt. % ground calcium carbonate applied to a 85 g/m$^2$ substrate. It is evident in FIG. 5 that the top ply formed as a distinct top layer without [penetration into the base substrate]. In FIG. 6, an SEM image at trial point 4 is depicted. The coating was applied at 48 g/m$^2$ and the top ply comprises 20 wt. % microfibrillated cellulose and 20 wt. % ground calcium carbonate and 60 wt. % talc (i.e., a ratio of 1:4 of microfibrillated cellulose and inorganic particulate material) applied to an 85 g/m$^2$ substrate. FIG. 6 clearly indicates that the top ply is applied to desirably stay as a layer on the surface of the substrate.

Comparative Trial:

Table 2 below presents data on a conventional white top linerboard produced on a similar paper machine but utilizing a conventional top ply applied to a base substrate of 82 g/m$^2$. The base was made from unbleached softwood Kraft fibre, and the white top layer was made with bleached hardwood (birch) Kraft fibre, within the typical range of filler loadings up to 20%. The base was targeted at 80 g/m$^2$ and the white layer was targeted at 60 g/m$^2$. Table 2 shows a typical result without microfibrillated cellulose, in which a 15 wt. % loading of a scalenohedral PCC (Optical HB) was used in the white layer. The base was rather stronger than for the Trials 1-4 above, but it can be seen that the drop in mechanical property indices from the addition of the top layer is also quite large. Given that the Trial 1-4 top ply layer can reach target brightness at a lower grammage than the conventional white top substrate, for a fixed total grammage the use of FiberLean should allow the board maker to use a higher proportion of unbleached long fibre in the product and thus achieve a stronger, stiffer product.

Table 2 below presents typical paper properties of various conventional linerboard grades.

TABLE 2

Typical paper properties of linerboard grades

| ca. 120 g/m$^2$ indicative properties | White Top Test liner | White Top Kraft liner | Coated White Top Test liner | Coated White Top Kraft liner |
|---|---|---|---|---|
| Bulk | 1.15 | 1.15 | 1.05 | 1.05 |
| Burst strength [kPa] | 250 | 500 | 300 | 700 |
| Internal Bond [J/m$^2$] | 250 | 350 | 300 | 350 |
| SCT cd [kN/m] | 1.7-2.0 | 3.0-4.0 | 2.3-2.7 | 3.0-4.0 |
| Cobb 60 seconds [g/m$^2$] | 30 | 30 | 30 | 30 |
| PPS [μm] | 3 | 3 | 2 | 2 |
| R457, C2° [%] | 65-75 | 75 | 80-85 | 77-82 |

Figure 7:
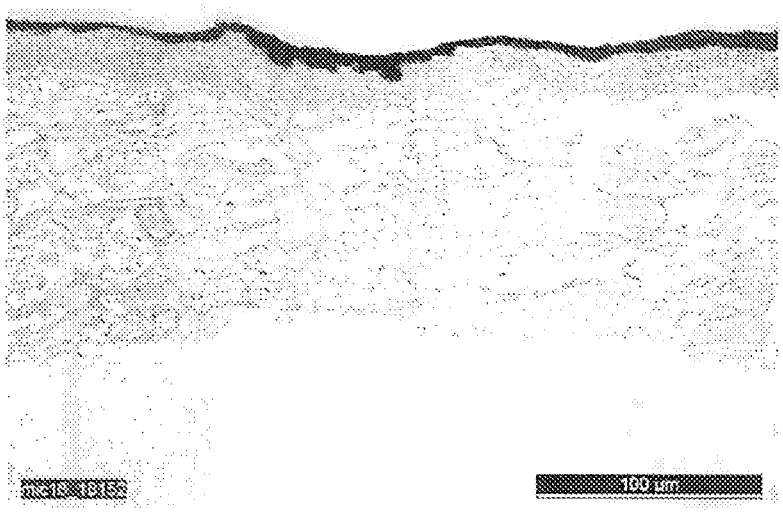
FIG. 7 presents a cross-section of a Flexography printed sample.

To demonstrate the printing properties of the white top linerboards of the present invention. FIG. 7 presents a cross-section of a Flexography printed sample. The ink is at the top of the top ply, as it should.

Example 3

In accordance with the set-up and parameters set forth in Examples 1 and 2, the continuous production of coated substrates with different coat weights and base substrates were studied. Trials 5-7 utilized a base paper (BP) made of 70% hardwood and 30% softwood, refined together to ca. 400 ml CSF, with a target grammage of 70 g/m2. The coatings applied to the BP in Trials 5-7 are identified as:

T5, ca. 20 g/m$^2$ composite coating (20% MFC, 80% GCC, no additives) on base paper BP T6, ca. 30 g/m$^2$ composite coating (20% MFC, 80% GCC, no additives) on base paper BP T7, ca. 40 g/m$^2$ composite coating (20% MFC, 80% GCC, no additives) on base paper BP Table 3 presents the data obtained in Trials 5-7.

TABLE 3

| | BP | T5 | T6 | T7 |
|---|---|---|---|---|
| Grammage g/m$^2$ | 72.6 | 90.3 | 99.3 | 111.1 |
| F8 Brightness % | 39.0 | 65.0 | 77.2 | 81.8 |
| Gurley Porosity Sec. | 3 | 51 | 185 | 300 |

It is evident from the data presented in Table 4 that the target brightness of the top ply coated onto the dark substrate was achieved in all of the Trial 5-7 runs.

Example 4

Table 4 presents data on printing performance of top ply coated linerboard substrates. Comparative References 1 and 2 comprise commercial coated inkjet paper and commercial uncoated inkjet paper respectively. The Print Sample is comprised of:

30 g/m$^2$ composite coating (20% MFC, 80% GCC) on porous base (70% hardwood and 30% softwood, ca. 400 ml CSF, 70 g/m$^2$). Paper obtained in a continuous production process. The Print Sample was made in accordance with Example 3. The roll-to-roll inkjet printing as applied at 50 m/min.

Table 4 presents the printing result of the Comparative Reference Samples 1 (Specialty inkjet paper, coated and calendared) and 2 (uncoated paper suitable for inkjet) versus the Print Sample an embodiment of the present invention.

TABLE 4

| | Reference 1 | Reference 2 | Print Sample |
|---|---|---|---|
| Optical Density Black | 1.29 | 0.94 | 1.07 |
| Optical Density Cyan | 0.98 | 0.96 | 0.98 |
| Optical Density Magenta | 1.07 | 0.98 | 0.87 |

The invention claimed is:

1. A paper or paperboard product comprising:

(i) a cellulose-containing substrate; wherein the cellulose-containing substrate comprises dark Kraft pulp, recycled pulp or a combination thereof; and (ii) a top ply comprising at least one inorganic particulate material and at least 5 wt. % to 30 wt. % microfibrillated cellulose based on the total weight of the top ply, wherein the inorganic particulate material content is 67 wt. % to 92 wt. % based on the total weight of the top ply, wherein the inorganic particulate material has a particle size distribution in which at least 20 wt. % to at least 95 wt. % of the particles have an equivalent spherical diameter (e.s.d.) of less than 2 wherein the brightness measured (according to ISO Standard 11475 (F8; D65-400 nm)) on the top ply is at least about 65%; wherein the top ply has a grammage of about 15 g/m$^2$ to about 40 g/m$^2$; and further wherein the microfibrillated cellulose is derived from fibrous substrate in the form of a pulp selected from the group consisting of chemical pulp, chemithermomechanical pulp, thermomechanical pulp, mechanical, pulp, recycled pulp, papermill broke, papermill waste stream, waste from a papermill, or combination thereof.

2. The paper or paperboard product according to claim 1, wherein the cellulose-containing substrate comprises either unbleached Kraft pulp or recycled paperboard.

3. The paper or paperboard product according to claim 2, wherein the recycled paperboard is old corrugated cardboard.

4. The product according to claim 1, 2 or 3, wherein the product comprises or is a white top containerboard product.

5. The product according to claim 4, wherein the substrate has a grammage suitable for use in a containerboard product, comprising a grammage ranging from 50 g/m$^2$ to 500 g/m$^2$.

6. The product according to claim 1, wherein the inorganic particulate material and the microfibrillated cellulose comprise greater than 95 wt. % of the top ply, based on the total weight of the top ply.

7. The product according to claim 1, wherein the top ply comprises at least 70 wt. % of an inorganic particulate material, based on the total weight of the top ply.

8. The product according to claim 1, wherein the top ply comprises at least 80 wt. % of an inorganic particulate material, based on the total weight of the top ply.

9. The product according to claim 1, wherein the top ply comprises at least 10 wt. % to 20 wt. % microfibrillated cellulose, based on the total weight of the top ply.

10. The product according to claim 9, wherein the top ply comprises at least one inorganic particulate material selected from the group consisting of: calcium carbonate, magnesium carbonate, dolomite, gypsum, an anhydrous kandite clay, kaolin, perlite, diatomaceous earth, wollastonite, talc, magnesium hydroxide, titanium dioxide, or aluminium trihydrate, or combinations thereof.

11. The product according to claim 10, wherein the top ply comprises at least one alkaline earth metal carbonate or sulphate.

12. The product according to claim 11, wherein the alkaline earth metal carbonate comprises calcium carbonate.

13. The product according to claim 10, wherein the calcium carbonate is precipitated calcium carbonate and/or ground calcium carbonate.

14. The product according to claim 1, wherein the product has a PPS roughness@1000 kPa measured on the top ply of no more than about 6.0 μm and/or a PPS roughness@1000 kPa measured on the top ply which is at least 2.0 μm less than the PPS roughness of the substrate absent the top ply.

15. The product according to claim 1, wherein the top ply comprises up to 2 wt. %, in total, of additives selected from the group consisting of: flocculant, formation/drainage aid, water soluble thickener, starch, retention aid and combinations thereof.

16. The product of claim 1, wherein the top ply is devoid of additional organic compound.

17. The product according to claim 16, wherein the top ply is devoid of cationic polymer, anionic polymer, or polysaccharide hydrocolloid.

18. The product of claim 1, wherein the top ply is devoid of wax, polyolefins, and silicone.

19. The product according to claim 1, wherein the substrate comprises up to 2 wt. % retention aid, based on the total weight of the substrate.

20. The product according to claim 1, wherein the substrate comprises up to 1 wt. % retention aid, based on the total weight of the substrate.

21. The product according to claim 1, wherein the top ply consists essentially of inorganic particulate and microfibrillated cellulose.

22. The product according to claim 1, further comprising a further layer or ply, or further layers or plies, on the ply comprising at least about 5 wt. % to about 30 wt. % microfibrillated cellulose, based on the total weight of the top ply.

23. The product according to claim 22, wherein at least one of the further layers or plies is a barrier layer or ply, or wax layer or ply, or silicon layer or ply.

* * * * *